United States Patent [19]

Dickerson et al.

[11] Patent Number: 4,900,652

[45] **Date of Patent: * Feb. 13, 1990**

[54] RADIOGRAPHIC ELEMENT

[75] Inventors: Robert E. Dickerson, Rochester; James E. Kelly, Pittsford; Donald R. Diehl; Ronda E. Factor, both of Rochester, all of N.Y.

[73] Assignee: Eastman Kodak Company, Rochester, N.Y.

[ * ] Notice: The portion of the term of this patent subsequent to Feb. 7, 2006 has been disclaimed.

[21] Appl. No.: 217,727

[22] Filed: Jul. 11, 1988

Related U.S. Application Data

[63] Continuation-in-part of Ser. No. 73,256, Jul. 13, 1987, Pat. No. 4,803,150.

[51] Int. Cl.[4] ..... G03C 1/46

[52] U.S. Cl. ..... 430/502; 430/507; 430/139; 430/517; 430/966

[58] Field of Search ..... 430/567, 966, 502, 517, 430/139, 570, 554, 555, 556, 557, 558, 559

[56] References Cited

U.S. PATENT DOCUMENTS

| | | | |
|---|---|---|---|
| 3,545,971 | 12/1970 | Barnes et al. . | |
| 4,092,168 | 5/1978 | Lemahieu et al. | 96/84 |
| 4,172,730 | 10/1979 | Hinata et al. | 430/966 |
| 4,411,986 | 10/1983 | Abbott et al. | 430/502 |
| 4,414,304 | 11/1983 | Dickerson | 430/966 |
| 4,425,425 | 1/1984 | Abbott et al. | 430/966 |
| 4,425,426 | 8/1988 | Abbott et al. | 430/966 |
| 4,439,520 | 3/1984 | Kofron et al. | 430/567 |
| 4,500,631 | 2/1985 | Sakamoto et al. | 430/413 |
| 4,803,150 | 2/1989 | Dickerson | 430/502 |

FOREIGN PATENT DOCUMENTS

| | | |
|---|---|---|
| 1414456 | 11/1975 | United Kingdom . |
| 1426277 | 2/1976 | United Kingdom . |
| 1477638 | 6/1977 | United Kingdom . |
| 1477639 | 6/1977 | United Kingdom . |

OTHER PUBLICATIONS

*Research Disclosure,* vol. 184, Aug. 1979, Item 18431, Sect. V.

*Research Disclosure,* vol. 146, Jun. 1976, Item 14661, pp. 59–60.

Factor and Diehl, U.S. Ser. No. 73,257, filed Jul. 13, 1987, titled Photographic Elements Having Oxonol Dyes.

Factor and Diehl, U.S. Ser. No. 137,402, filed Dec. 23, 1987, titled Solid Particle Dispersions of Dyes Useful in Photographic Elements, and Factor and Diehl, U.S. Ser. No. 137,491, filed Dec. 23, 1987, titled Filter Dyes for Photographic Elements, both commonly assigned.

Diehl and Factor, U.S. Ser. No. 137,495, filed Dec. 23, 1987, titled Solid Particle Dispersion Filter Dyes for Photographic Compositions.

*Primary Examiner*—Paul R. Michl
*Assistant Examiner*—T. Neville
*Attorney, Agent, or Firm*—Carl O. Thomas

[57] ABSTRACT

A radiographic element is disclosed which exhibits high covering power, reduced crossover without emulsion desensitization, reduced wet pressure sensitivity, and can be fully processed in a rapid transport processor in less than 90 seconds. The radiographic is comprised of tabular grain emulsion layers on opposite sides of a transparent film support and processing solution decolorizable dye particles in hydrophilic colloid layers interposed between the emulsion layers and the support. Hydrophilic colloid on each side of the support is in the range of from 35 to 65 mg/dm$^2$, with the interposed layer containing hydrophilic colloid in the amount of at least 10 mg/dm$^2$.

14 Claims, 2 Drawing Sheets

RADIOGRAPHIC ELEMENT

This is a continuation-in-part of Dickerson, Kelly, Diehl, and Factor U.S. Ser. No. 73,256, filed July 13, 1987, now U.S. Pat. No. 4,803,150.

FIELD OF THE INVENTION

The invention relates to radiography. More specifically, the invention relates to double coated silver halide radiographic elements of the type employed in combination with intensifying screens.

RELATED COMMONLY ASSIGNED FILINGS

Diehl and Factor U.S. Ser. No. 137,490, filed Dec. 23, 1987, as a continuation-in-part of U.S. Ser. No. 945,634, filed Dec. 23, 1986, now abandoned, titled MICROCRYSTALLINE DYE DISPERSIONS FOR PHOTOGRAPHIC FILTER LAYERS claims novel microcrystalline arylidene dyes capable of being decolorized during photographic processing. U.S. Ser. No. 137,490 has now been abandoned in favor of continuing application U.S. Ser. No. 373,747, filed June 30, 1989.

Factor and Diehl U.S. Ser. No. 73,257, filed July 13, 1987, titled PHOTOGRAPHIC ELEMENTS HAVING OXONOL DYES claims a photographic element having thereon a layer comprising a microcrystalline oxonol dye capable of being decolorized during photographic processing.

Factor and Diehl U.S. Ser. No. 137,402, filed Dec. 23, 1987, titled SOLID PARTICLE DISPERSIONS OF DYES USEFUL IN PHOTOGRAPHIC ELEMENTS, now abandoned in favor of U.S. Ser. No. 372,142, filed June 27, 1989, and Factor and Diehl U.S. Ser. No. 137,491, filed Dec. 23, 1987, titled FILTER DYES FOR PHOTOGRAPHIC ELEMENTS, now abandoned in favor of U.S. Ser. No. 290,602, filed Dec. 23, 1988, all commonly assigned, disclose certain (1) oxazole and oxazoline pyrazolone merocyanine and (2) oxazole or oxazoline benzoylacetonitrile merocyanine dyes, respectively, specified by formula, to be filter dyes capable of being decolorized during photographic processing. The dyes are disclosed to be incorporated in photographic elements and in radiographic elements to reduce crossover.

Diehl and Factor U.S. Ser. No. 137,495, filed Dec. 23, 1987, titled SOLID PARTICLE DISPERSION FILTER DYES FOR PHOTOGRAPHIC COMPOSITIONS, commonly assigned, discloses dyes having an aromatic ring and a substituent thereof containing an ionizable proton to be filter dyes capable of being decolorized during photographic processing. The dyes are disclosed to be incorporated in photographic elements and in radiographic elements to reduce crossover. U.S. Ser. No. 137,495 has now been abandoned in favor of continuing application U.S. Ser. No. 373,749, filed June 30, 1989.

BACKGROUND OF THE INVENTION

Photographic elements relying on silver halide emulsions for image recording have been recognized to possess outstanding sensitivity to light for more than a century. Roentgen discovered X radiation by the inadvertent exposure of a silver halide photographic element. In 1913 the Eastman Kodak Company introduced its first product specifically intended to be exposed by X radiation.

The desirability of limiting patient exposure to high levels of X radiation has been recognized from the inception of medical radiography. In 1918 the Eastman Kodak Company introduced the first medical radiographic product which was dual coated that is, coated with silver halide emulsion layers on the front and back of the support.

At the same time it was recognized that silver halide emulsions are more responsive to light than to X rays. The Patterson Screen Company in 1918 introduced matched intensifying screens for Kodak's first dual coated (Duplitized ®) radiographic element. An intensifying screen contains a phosphor which absorbs X radiation and emits radiation in the visible spectrum or in an adjacent spectral region—i.e., the ultraviolet or infrared.

*Research Disclosure*, Vol. 184, August 1979, Item 18431, summarizes the state of the art of constructing radiographic elements, including dual coated radiographic elements, prior to the commercial introduction of thin tabular grain (T-Grain ®) emulsions in radiographic elements. *Research Disclosure* is published by Kenneth Mason Publications, Ltd., Emsworth, Hampshire P010 7DD, England.

By 1979 rapid access processing of radiographic elements was well established. In rapid access processing an imagewise exposed radiographic element is introduced into a processor and emerges in 1 to 2 minutes fully processed and dry to the touch. Rapid access processing is illustrated by Barnes et al U.S. Pat. No. 3,545,971.

Successful rapid access processing requires limiting the drying load that is, the water ingested by the hydrophilic colloid layers, principally the silver halide emulsion layers, that must be evaporated to produce a dry image bearing element. One possible approach is to foreharden the radiographic element fully, thereby reducing swelling (water ingestion) during processing. Because silver image covering power (maximum density divided by the silver coating coverage) of pre-T-grain radiographic elements was markedly reduced by forehardening of the radiographic elements, it was the accepted practice not to foreharden the radiographic elements fully, but to complete hardening of radiographic elements during rapid access processing by incorporating a pre-hardener, typically glutaraldehyde, in the developer.

Since silver halide emulsions require hydrophilic colloid for their preparation and full forehardening of emulsion layers leads to marked reductions in silver covering power, reduction of the drying load on the rapid processors has been achieved by limiting the hydrophilic colloid content of radiographic elements. However, when the hydrophilic colloid content of the emulsion layer falls too low, the problem of wet pressure sensitivity is encountered. Wet pressure sensitivity is the appearance of graininess produced by applying pressure to the wet emulsion during development. In rapid access processing the radiographic element passes over guide rolls, which are capable of applying sufficient pressure to the wet emulsion during development to render any wet pressure sensitivity propensity of a radiographic element manifest, particularly if any of the guide rolls are in less than optimum adjustment.

An image sharpness limitation of dual coated radiographic elements results from light emitted by each intensifying screen passing through the transparent film support to expose the silver halide emulsion layer on the opposite side of the support to light. A variety of conventional pre-T-Grain techniques for reduction of crossover are set out in *Research Disclosure*, Item 18431, cited above, Section V. These crossover reduction techniques have the disadvantage of (a) reducing radiographic imaging speed, (b) increasing the minimum density of the image, (c) interfering with successful rapid access processing, and/or (d) complicating the manufacture or use of the radiographic elements.

As a result, in 1979 radiographic elements used commercially routinely exhibited crossover levels in excess of about 20 percent.

One approach suggested prior to 1979 for crossover reduction was to dissolve a filter dye in one or more of the hydrophilic colloid layers forming the radiographic element. Such dyes must, of course, be selected to minimize residual density (stain) in the image bearing radiographic element. A pervasive problem with dissolved dyes has been their migration to the latent image forming silver halide grains, whether coated directly in the image forming emulsion layers or in underlying layers. This has resulted in loss of photographic speed, which, of course, runs directly counter to the general aim in adopting a double coated radiographic element format in the first instance. Thus, where this approach has been followed, a balance of dye desensitization and residual crossover has been accepted. Although mordants have been employed to reduce dye migration, they have not been effective in preventing loss of photographic speed or have increased dye stain. The dissolved dye approach to crossover reduction is illustrated by Doorselaer U.K. Pat. Spec. No. 1,414,456 and Bollen et al U.K. Pat. Spec. No. 1,477,638 and 1,477,639.

To reduce dye migration to the image forming silver halide grains a variant approach has been to adsorb the dye to the surfaces of silver halide grains other than those employed in imaging. This approach reduces speed loss, but has the disadvantage of requiring silver halide grains to be present in addition to those required for latent image formation, thereby significantly increasing silver coverages. Further, an added silver halide grain population increases hydrophilic colloid requirements and correspondingly increases drying times. Millikan et al U.K. Pat. Spec. No. 1,426,277 illustrates this approach applied to a specialized photographic imaging system in which a silver halide grain population is present in addition to the grain population which is relied upon to produce a latent image.

It has not in general been found feasible to employ in radiographic elements to reduce crossover filter layers of the type found in other photographic elements. For example, the most common filter layers encountered in color photography, Carey Lea silver layers, are unacceptable in radiographic elements, since they leave high residual stain levels. Lemahieu et al U.S. Pat. No. 4,092,168 discloses the use of particulate filter dyes in photographic elements, but contains no mention of utility in radiographic elements.

When T-Grain emulsions (emulsions in which tabular grains having a thickness of less than 0.30 μm account for greater than 50 percent of the total grain projected area and have an average aspect ratio of greater than 5:1) were introduced, the performance characteristics of radiographic elements, particularly dual coated radiographic elements, improved markedly in a number of respects. Kofron et al U.S. Pat. No. 4,439,520 taught that chemically and spectrally sensitized T-Grain emulsions improve image sharpness (in ways unrelated to crossover) and improve the speed-granularity relationship of the emulsions. T-Grain emulsions are known to exhibit superior covering power levels when compared to other emulsions of comparable speed. As a corollary, less silver is required to match the performance of other emulsions. Dickerson U.S. Pat. No. 4,414,304 taught that T-Grain emulsions are more resistant to loss of covering power on forehardening. This allows radiographic elements to be fully forehardened or at least forehardened to a greater extent, reducing the risk of film damage in handling and allowing processing to be simplified by the reduction or elimination of prehardening. Abbott et al U.S. Pat. Nos. 4,425,425 and 4,425,425 taught that substantially optimally spectrally sensitized T-Grain emulsions are capable of reducing crossover into the 15 to 20 percent range without resorting to any of the conventional crossover reduction techniques taught by Item 18431, Section V, or incurring their attendant disadvantages.

SUMMARY OF THE INVENTION

While the incorporation of T-Grain emulsions into dual coated radiographic elements has advanced the state of the art, leading to a variety of advantages, including but not limited to those specifically mentioned above, it is an object of the present invention to make available to the art for the first time a dual coated radiographic element which (1) realizes the advantages of T-Grain emulsion containing radiographic elements, (2) exhibits significantly reduced crossover levels (below 10 percent and preferably negligibly low crossover levels, hereinafter referred to as zero crossover levels), and (3) retains the capability of rapid access processing while eliminating or significantly reducing the disadvantages (a), (b), (c), and (d) of conventional crossover reduction techniques, discussed above.

In one aspect of this invention is directed to a radiographic element comprises of a film support capable of transmitting radiation to which the radiographic element is responsive having opposed major surfaces, and, coated on said the major surfaces, processing solution permeable hardenable hydrophilic colloid layers including at least one silver halide emulsion layer comprises of silver bromide and bromoiodide grains including tabular grains having a thickness of less than 0.3 μm which have an average aspect ratio of greater than 5:1 and account for greater than 50 percent of the total grain projected area and spectral sensitizing dye adsorbed to the surface of said grains in an amount sufficient to substantially optimally spectrally sensitize said emulsion layer and a layer interposed between the said silver halide emulsion layer and said support containing a dye capable of absorbing radiation to which said emulsion layer coated on the opposite of said major surfaces is responsive to reduce crossover.

The radiographic element is characterized in that (1) the dye in the interposed layer is prior to processing in the form of particles, is present in an amount sufficient to reduce crossover to less than 10 percent, and is capable of being substantially decolorized during processing, (2) the interposed layer contains at least 10 mg/dm$^2$ of hardenable hydrophilic colloid, (3) the emulsion layers contain a combined silver coating coverage sufficient to produce a maximum density on processing in the range of from 3 to 4, (4) the interposed layer contains at least 10 mg/dm$^2$ of hardenable hydrophilic colloid, (5) a total of from 35 to 65 mg/dm$^2$ of processing solution permeable hardenable hydrophilic colloid is coated on each of the opposed major surfaces of the support, and (6) the processing solution permeable hydrophilic colloid layers are forehardened in an amount sufficient to reduce swelling of the layers to less than 300 percent, percent swelling being determined by (a) incubating said radiographic element at 38° C. for 3 days at 50 percent relative humidity, (b) measuring layer thickness, (c) immersing the radiographic element in distilled water at 21° C. for 3 minutes, and (d) determining the percent change in layer thickness as compared to the layer thickness measured in step (b), whereby the radiographic element exhibits high covering power, reduced crossover without emulsion desensitization, reduced wet pressure sensitivity, and can be developed, fixed, washed, and emerge dry to the touch in a 90 second 35° C. process cycle consisting of

| | |
|---|---|
| development | 24 seconds at 40° C., |
| fixing | 20 seconds at 40° C., |
| washing | 10 seconds at 40° C., and |
| drying | 20 seconds at 65° C., |

where the remaining time is transport between processing steps, the development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |
| Water to 1 liter at pH 10.0, and | |

the fixing step employs the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to | 4.5. |

DESCRIPTION OF PREFERRED EMBODIMENTS

Figure 1:
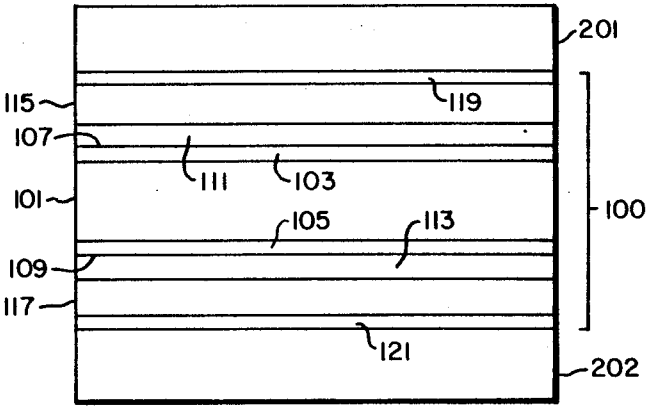

Referring to FIG. 1, in the assembly shown a radiographic element 100 according to this invention is positioned between a pair of light emitting intensifying screens 201 and 202. The radiographic element support is comprised of a radiographic support element 101, typically transparent or blue tinted, capable of transmitting at least a portion of the light to which it is exposed and optional, similarly transmissive under layer units 103 and 105. On the first and second opposed major faces 107 and 109 of the support formed by the under layer units are crossover reducing hydrophilic colloid layers 111 and 113, respectively. Overlying the crossover reducing layers 111 and 113 are light recording latent image forming silver halide emulsion layer units 115 and 117, respectively. Each of the emulsion layer units is formed of one or more hydrophilic colloid layers including at least one silver halide emulsion layer. Overlying the emulsion layer units 115 and 117 are optional hydrophilic colloid protective overcoat layers 119 and 121, respectively. All of the hydrophilic colloid layers are permeable to processing solutions.

In use, the assembly is imagewise exposed to X radiation. The X radiation is principally absorbed by the intensifying screens 201 and 202, which promptly emit light as a direct function of X ray exposure. Considering first the light emitted by screen 201, the light recording latent image forming emulsion layer unit 115 is positioned adjacent this screen to receive the light which it emits. Because of the proximity of the screen 201 to the emulsion layer unit 115 only minimal light scattering occurs before latent image forming absorption occurs in this layer unit. Hence light emission from screen 201 forms a sharp image in emulsion layer unit 115.

However, not all of the light emitted by screen 201 is absorbed within emulsion layer unit 115. This remaining light, unless otherwise absorbed, will reach the remote emulsion layer unit 117, resulting in a highly unsharp image being formed in this remote emulsion layer unit. Both crossover reducing layers 111 and 113 are interposed between the screen 201 and the remote emulsion layer unit and are capable of intercepting and attenuating this remaining light. Both of these layers thereby contribute to reducing crossover exposure of emulsion layer unit 117 by the screen 201. In an exactly analogous manner the screen 202 produces a sharp image in emulsion layer unit 117, and the light absorbing layers 111 and 113 similarly reduce crossover exposure of the emulsion layer unit 115 by the screen 202.

Following exposure to produce a stored latent image, the radiographic element 100 is removed from associated with the intensifying screens 210 and 202 and processed in a rapid access processor—that is, a processor, such as an RP-X-Omat® processor, which is capable of producing a image bearing radiographic element dry to the touch in less than 90 seconds. Rapid access processors are illustrated by Barnes et al U.S. Pat. No. 3,545,971 and Akio et al published European patent application No. 0,248,390.

Since rapid access processors employed commercially vary in their specific processing cycles and selections of processing solutions, the radiographic elements satisfying the requirements of the present invention are specifically identified as being those that are capable of emerging dry to the touch when processed in 90 seconds according to the following reference conditions:

| | |
|---|---|
| development | 20 seconds at 40° C., |
| fixing | 12 seconds at 40° C., |
| washing | 8 seconds at 40° C., and |
| drying | 20 seconds at 65° C., |

where the remaining time is taken up in transport between processing steps. The development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |
| Water to 1 liter at pH 10.0, and | |

the fixing step employs the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to | 4.5. |

The radiographic elements of the present invention make possible the unique combination of advantages set forth above by employing (1) substantially optimally spectrally sensitized tabular grain emulsions in the emulsion layer units to reach low crossover levels while achieving the high covering power and other known advantages of tabular grain emulsions, (2) one or more particulate dyes in the interlayer units to further reduce crossover to less than 10 percent without emulsion desensitization and minimal or no residual dye stain, and (3) hydrophilic colloid swell and coverage levels compatible with obtaining uniform coatings, rapid access processing, and reduced or eliminated wet pressure sensitivity. Each of these essential features of the invention is discussed in more detail below:

Each under layer unit contains a processing solution hydrophilic colloid and a particulate dye. The total concentration of the microcrystalline dye in both under layer units is sufficient to reduce the crossover of the radiographic element below 10 percent. This can be achieved when the concentration of the dye is chosen to impart to the structure separating the emulsion layer units an optical density of at least 2.00 at the peak wavelength of emulsion sensitivity. Although the dye can be unequally distributed between the two under layer units, it is preferred that each under layer unit contain sufficient dye to raise the optical density of that under layer unit to 1.00. Using the latter value as a point of reference, since it is conventional practice to employ intensifying screen-radiographic element combinations in which the peak emulsion sensitivity matches the peak light emission by the intensifying screens, it follows that the dye also exhibits a density of at least 1.00 at the wavelength of peak emission of the intensifying screen. Since neither screen emissions nor emulsion sensitivities are confined to a single wavelength, it is preferred to choose particulate dyes, including combinations of particulate dyes, capable of imparting a density of 1.00 or more over the entire spectral region of significant sensitivity and emission. For radiographic elements to be used with blue emitting intensifying screens, such as those which employ calcium tungstate or thulium activated lanthanum oxybromide phosphors, it is essentially preferred that the particulate dye be selected to produce an optical density of at least 1.00 over the entire spectral region of 400 to 500 nm. For radiographic elements intended to be used with green emitting intensifying screens, such as those employing rare earth (e.g., terbium) activated gadolinium oxysulfide or oxyhalide phosphors, it is preferred that the particulate dye exhibit a density of at least 1.00 over the spectral region of 450 to 550 nm. To the extent the wavelength of emission of the screens or the sensitivities of the emulsion layers are restricted, the spectral region over which the particulate dye must also effectively absorb light is correspondingly reduced.

While particulate dye optical densities of 1.00, chosen as described above, are effective to reduce crossover to less than 10 percent, it is specifically recognized that particulate dye densities can be increased until radiographic element crossover is effectively eliminated. For example, by increasing the particulate dye concentration so that it imparts a density of 2.0 to the radiographic element, crossover is reduced to only 1 percent.

Since there is a direct relationship between the dye concentration and the optical density produced for a given dye or dye combination, precise optical density selections can be achieved by routine selection procedures. Because dyes vary widely in their extinction coefficients and absorption profiles, it is recognized that the weight or even molar concentrations of particulate dyes will vary from one dye or dye combination selection to the next.

The size of the dye particles is chosen to facilitate coating and rapid decolorization of the dye. In general smaller dye particles lend themselves to more uniform coatings and more rapid decolorization. The dye particles employed in all instances have a mean diameter of less than 10.0 μm and preferably less than 1.0 μm. There is no theoretical limit on the minimum sizes the dye particles can take. The dye particles can be most conveniently formed by crystallization from solution in sizes ranging down to about 0.01 μm or less. Where the dyes are initially crystallized in the form of particles larger than desired for use, conventional techniques for achieving smaller particle sizes can be employed, such as ball milling, roller milling, sand milling, and the like.

An important criterion in dye selection is their ability to remain in particulate form in hydrophilic colloid layers of radiographic elements. While the hydrophilic colloids can take any of various conventional forms, such as any of the forms set forth in *Research Disclosure*, Vol. 176, Dec. 1978, Item 17643, Section IX, Vehicles and vehicle extenders, here incorporated by reference, the hydrophilic colloid layers are most commonly gelatin and gelatin derivatives (e.g., acetylated or phthalated gelatin). To achieve adequate coating uniformity the hydrophilic colloid must be coated at a layer coverage of at least 10 mg/dm$^2$. Any convenient higher coating coverage can be employed, provided the total hydrophilic colloid coverage per side of the radiographic element does not exceed that compatible with rapid access processing. Hydrophilic colloids are typically coated as aqueous solutions in the pH range of from about 5 to 6, most typically from 5.5 to 6.0, to form radiographic element layers. The dyes which are selected for use in the practice of this invention are those which are capable of remaining in particulate form at those pH levels in aqueous solutions.

Dyes which by reason of their chromophoric make up are inherently ionic, such as cyanine dyes, as well as dyes which contain substituents which are ionically dissociated in the above-noted pH ranges of coating may in individual instances be sufficiently insoluble to satisfy the requirements of this invention, but do not in general constitute preferred classes of dyes for use in the practice of the invention. For example, dyes with sulfonic acid substituents are normally too soluble to satisfy the requirements of the invention. On the other hand, nonionic dyes with carboxylic acid groups (depending in some instances on the specific substitution location of the carboxylic acid group) are in general insoluble under aqueous acid coating conditions. Specific dye selections can be made from known dye characteristics or by observing solubilities in the pH range of from 5.5 to 6.0 at normal layer coating temperatures—e.g., at a reference temperature of 40° C.

Preferred particulate dyes are nonionic polymethine dyes, which include the merocyanine, oxonol, hemioxonol, styryl, and arylidene dyes.

The merocyanine dyes include, joined by a methine linkage, at least one specific heterocyclic nucleus and at least one acidic nucleus. The nuclei can be joined by an even number or methine groups or in so-called "zero methine" merocyanine dyes, the methine linkage takes the form of a double bond between methine groups incorporated in the nuclei. Basic nuclei, such as azolium or azinium nuclei, for example, include those derived from pyridinium, quinolinium, isoquinolinium, oxazolium, pyrazolium, pyrrolium, indolium, oxadiazolium, 3H—or 1H-benzoindolium, pyrrolopyridinium, phenanthrothiazolium, and acenaphthothiazolium quaternary salts.

Exemplary of the basic heterocyclic nuclei are those satisfying Formulae I and II.

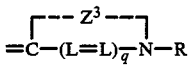

(I)

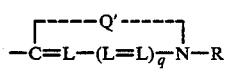

(II)

where $Z^3$ represents the elements needed to complete a cyclic nucleus derived from basic heterocyclic nitrogen compounds such as oxazoline, oxazole, benzoxazole, the naphthoxazoles (e.g., naphth[2,1-d]oxazole, naphth[2,3-d]oxazole, and naphth[1,2-d]oxazole), oxadiazole, 2- or 4-pyridine, 2- or 4-quinoline, 1- or 3-isoquinoline, benzoquinoline, 1H- or 3H-benzoindole, and pyrazole, which nuclei may be substituted on the ring by one or more of a wide variety of substituents such as hydroxy, the halogens (e.g., fluoro, chloro, bromo, and iodo), alkyl groups or substituted alkyl groups (e.g., methyl, ethyl, propyl, isopropyl, butyl, octyl, dodecyl, octadecyl, 2-hydroxyethyl, 2-cyanoethyl, and trifluoromethyl), aryl groups or substituted aryl groups (e.g., phenyl, 1-naphthyl, 2-naphthyl, 3-carboxyphenyl, and 4-biphenylyl), aralkyl groups (e.g., benzyl and phenethyl), alkoxy groups (e.g., methoxy, ethoxy, and isopropoxy), aryloxy groups (e.g., phenoxy and 1-naphthoxy), alkylthio groups (e.g., methylthio and ethylthio), arylthio groups (e.g., phenylthio, p-tolylthio, and 2-naphthylthio), methylenedioxy, cyano, 2-thienyl, styryl, amino or substituted amino groups (e.g., anilino, dimethylamino, diethylamino, and morpholino), acyl groups, (e.g., formyl, acetyl, benzoyl, and benzenesulfonyl);

Q′ represents the elements needed to complete a cyclic nucleus derived from basic heterocyclic nitrogen compounds such as pyrrole, pyrazole, indazole, and pyrrolopyridine;

R represents alkyl groups, aryl groups, alkenyl groups, or aralkyl groups, with or without substituents, (e.g., carboxy, hydroxy, sulfo, alkoxy, sulfato, thiosulfato, phosphono, chloro, and bromo substituents);

L is in each occurrence independently selected to represent a substituted or unsubstituted methine group—e.g., $—CR^8=$ groups, where $R^8$ represents hydrogen when the methine group is unsubstituted and most commonly represents alkyl of from 1 to 4 carbon atoms or phenyl when the methine groups is substituted; and q is 0 or 1.

Merocyanine dyes link one of the basic heterocyclic nuclei described above to an acidic keto methylene nucleus through a methine linkage, where the methine groups can take the form $—CR^8=$ described above. The greater the number of the methine groups linking nuclei in the polymethine dyes in general and the merocyanine dyes in particular the longer the absorption wavelengths of the dyes.

Merocyanine dyes link one of the basic heterocyclic nuclei described above to an acidic keto methylene nucleus through a methine linkage as described above. Exemplary acidic nuclei are those which satisfy Formula III.

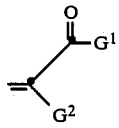

(III)

where $G^1$ represents an alkyl group or substituted alkyl group, an aryl or substituted aryl group, an aralkyl group, an alkoxy group, an aryloxy group, a hydroxy group, an amino group, or a substituted amino group, wherein exemplary substituents can take the various forms noted in connection with Formulae VI and VII;

$G^2$ can represent any one of the groups listed for $G^1$ and in addition can represent a cyano group, an alkyl, or arylsulfonyl group, or a group represented by

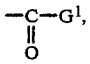

or $G^2$ taken together with $G^1$ can represent the elements needed to complete a cyclic acidic nucleus such as those derived from 2,4-oxazolidinone (e.g., 3-ethyl-2,4-oxazolidindione), 2,4-thiazolidindione (e.g., 3-methyl-2,4-thiazolidindione), 2-thio-2,4-oxazolidindione (e.g., 3-phenyl-2-thio-2,4-oxazolidindione), rhodanine, such as 3-ethylrhodanine, 3-phenylrhodanine, 3-(3-dimethylaminopropyl)rhodanine, and 3-carboxymethylrhodanine, hydantoin (e.g., 1,3-diethylhydantoin and 3-ethyl-1-phenylhydantoin), 2-thiohydantoin (e.g., 1-ethyl-3-phenyl-2-thiohydantoin, 3-heptyl-1-phenyl-2-thiohydantoin, and arylsulfonyl-2-thiohydantoin), 2-pyrazolin-5-one, such as 3-methyl-1-phenyl-2-pyrazolin-5-one and 3-methyl-1-(4-carboxyphenyl)-2-pyrazolin-5-one, 2-isoxazolin-5-one (e.g., 3-phenyl-2-isoxazolin-5-one), 3,5-pyrazolidindione (e.g., 1,2-diethyl-3,5-pyrazolidindione and 1,2-diphenyl-3,5-pyrazolidindione), 1,3-indandione, 1,3-dioxane-4,6-dione, 1,3-cyclohexanedione, barbituric acid (e.g., 1-ethylbarbituric acid and 1,3-diethylbarbituric acid), and 2-thiobarbituric acid (e.g., 1,3-diethyl-2-thiobarbituric acid and 1,3-bis(2-methoxyethyl)-2-thiobarbituric acid).

Useful hemioxonol dyes exhibit a keto methylene nucleus as shown in Formula III and a nucleus as shown in Formula IV.

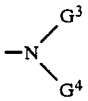

(IV)

where $G^3$ and $G^4$ may be the same or different and may represent alkyl, substituted alkyl, aryl, substituted aryl, or aralkyl, as illustrated for R ring substituents in Formula I or $G^3$ and $G^4$ taken together complete a ring system derived from a cyclic secondary amine, such as pyrrolidine, 3-pyrroline, piperidine, piperazine (e.g., 4-methylpiperazine and 4-phenylpiperazine), morpholine, 1,2,3,4-tetrahydroquinoline, decahydroquinoline, 3-azabicyclo[3,2,2]nonane, indoline, azetidine, and hexahydroazepine.

Exemplary oxonol dyes exhibit two keto methylene nuclei as shown in Formula III joined through one or higher uneven number of methine groups.

Useful arylidene dyes exhibit a keto methylene nucleus as shown in Formula III and a nucleus as shown in Formula V joined by a methine linkage as described above containing one or a higher uneven number of methine groups.

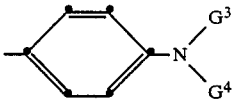

(V)

where $G^3$ and $G^4$ are as previously defined.

A specifically preferred class of oxonol dyes for use in the practice of the invention are the oxonol dyes disclosed in Factor and Diehl U.S. Ser. No. 73,257, filed July 13, 1987, commonly assigned, cited above. These oxonol dyes satisfy Formula VI.

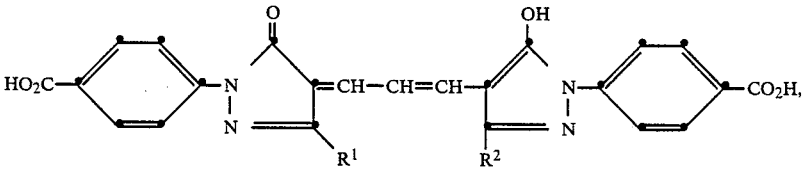

(VI)

wherein $R^1$ and $R^2$ each independently represent alkyl of from 1 to 5 carbon atoms.

A specifically preferred class of arylidene dyes for use in the practice of the invention are the arylidene dyes disclosed in Diehl and Factor U.S. Ser. Nos. 945,634, and 137,490 refiled as 373,747, commonly assigned, cited above. These arylidene dyes satisfy Formula VII.

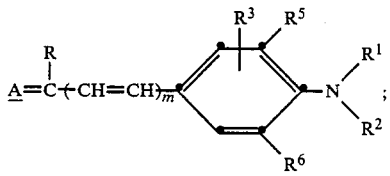

(VII)

A represents a substituted or unsubstituted acidic nucleus having a carboxyphenyl or sulfonamidophenyl substituent selected from the group consisting of 2-pyrazolin-5-ones free of any substituent bonded thereto through a carboxyl group, rhodanines; hydantoins; 2-thiohydantoins; 4-thiohydantoins; 2,4-oxazolidindiones; 2-thio-2,4-oxazolidindiones; isoxazolinones; barbiturics; 2-thiobarbiturics and indandiones;

R represents hydrogen, alkyl of 1 to 4 carbon atoms or benzyl;

$R^1$ and $R^2$, each independently, represents alkyl or aryl; or taken together with $R^5$, $R^6$, N, and the carbon atoms to which they are attached represent the atoms needed to complete a julolidene ring;

$R^3$ represents H, alkyl or aryl;

$R^5$ and $R^6$, each independently, represents H or $R^5$ taken together with $R^1$; or $R^6$ taken together with $R^2$ each may represent the atoms necessary to complete a 5 or 6 membered ring; and m is 0 or 1.

Oxazole and oxazoline pyrazolone merocyanine particulate dyes of the type disclosed by Factor and Diehl U.S. Ser. No. 137,402 (refiled as 372,142), commonly assigned, cited above, are also contemplated. These particulate dyes can be represented by Formula VIII.

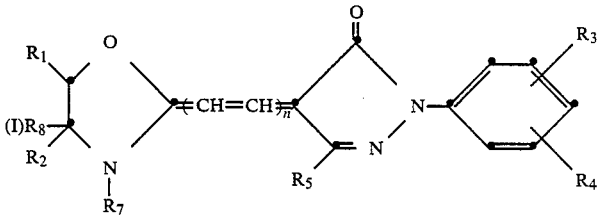

(VII)

In formula (I), $R_1$ and $R_2$ are each independently substituted or unsubstituted alkyl or substituted or unsubstituted aryl, or together represent the atoms necessary to complete a substituted or unsubstituted 5- or 6-membered ring.

$R_3$ and $R_4$ each independently represents H, substituted or unsubstituted alkyl, substituted or unsubstituted aryl, $CO_2H$, or $NHSO_2R_6$. $R_5$ is H, substituted or unsubstituted alkyl, substituted or unsubstituted aryl, carboxylate (i.e., COOR where R is substituted or unsubstituted alkyl), or substituted or unsubstituted acyl, $R_6$ and $R_7$ are each independently substituted or unsubstituted alkyl or substituted or unsubstituted aryl, and n is 1 or 2. $R_8$ is either substituted or unsubstituted alkyl, or is part of a double bond between the ring carbon atoms to which $R_1$ and $R_2$ are attached. At least one of the aryl rings of the dye molecule must have at least one substituent that is $CO_2H$ or $NHSO_2R_6$.

Oxazole and oxazoline benzoylacetonitrile merocyanine particulate dyes of the type disclosed by Factor and Diehl U.S. Ser. No. 137,491 (refiled as 290,602), commonly assigned, cited above, are also contemplated. These particulate dyes can be represented by Formula IX.

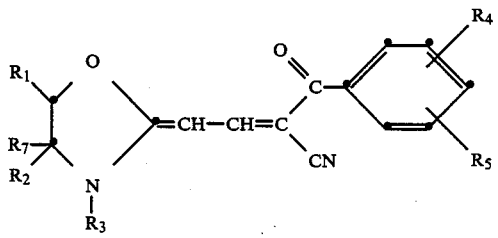

(IX)

In Formula IX, $R_1$, $R_2$, $R_3$, $R_4$, $R_5$, and $R_6$ may be substituted or unsubstituted alkyl or substituted or unsubstituted aryl, preferably substituted or unsubstituted alkyl of 1 to 6 carbon atoms or substituted or unsubstituted aryl of 6 to 12 carbon atoms. $R_7$ may be substituted or unsubstituted alkyl of from 1 to 6 carbon atoms. The alkyl or aryl groups may be substituted with any of a number of substituents as is known in the art, other than those, such as sulfo substituents, that would tend to increase the solubility of the dye so much as to cause it to become soluble at coating pH's. Examples of useful substituents include halogen, alkoxy, ester groups, amido, acyl, and alkylamino. Examples of alkyl groups include methyl, ethyl, n-propyl, isopropyl, n-butyl, isobutyl, n-pentyl, n-hexyl, or isohexyl. Examples of aryl groups include phenyl, naphthyl, anthracenyl, pyridyl, and styryl.

$R_1$ and $R_2$ may also together represent the atoms necessary to complete a substituted or unsubstituted 5- or 6-membered ring, such as phenyl, naphthyl, pyridyl, cyclohexyl, dihydronaphthyl, or acenaphthyl. This ring may be substituted with substituents, other than those, such as sulfo substituents, that would tend to increase the solubility of the dye so mush as to cause it to become soluble at coating pH's. Examples of useful substituents include halogen, alkyl, alkoxy, ester, amido, acyl, and alkylamino.

Useful bleachable particulate dyes can be found among a wide range of cyanine, merocyanine, oxonol, arylidene (i.e., merostyryl), anthraquinone, triphenylmethine, azo, azomethine, and other dyes, provided certain criteria are met identified in Diehl and Factor U.S. Ser. No. 137,495 (refiled as 373,749), commonly assigned, cited above. Such dyes satisfy Formula X.

$$[D-(A)_y]-X_n \qquad (X)$$

where D is a chromophoric light-absorbing compound, which may or may not comprise an aromatic ring if y is not 0 and which comprises an aromatic ring if y is 0, A is an aromatic ring bonded directly or indirectly to D, X is a substituent, either on A or on an aromatic ring portion of D, with an ionizable proton, y is 0 to 4, and n is 1 to 7, where the dye is substantially aqueous insoluble at a pH of 6 or below and substantially aqueous soluble at a pH of 8 or above.

Synthesis of the particulate dyes can be achieved by procedures known in the art for the synthesis of dyes of the same classes. For example, those familiar with techniques for dye synthesis disclosed in "*The Cyanine Dyes and Related Compounds*", Frances Hamer, Interscience Publishers, 1964, could readily synthesize the cyanine, merocyanine, merostyryl, and other polymethine dyes. The oxonol, anthraquinone, triphenylmethane, azo, and azomethine dyes are either known dyes or substituent variants of known dyes of these classes and can be synthesized by known or obvious variants of known synthetic techniques forming dyes of these classes. Specific illustrations of dye preparations are incorporated in the Appendix below.

Examples of particulate bleachable dyes useful in the practice of this invention include the following:

TABLE I

Trimethine Pyrazolone Cinnamylidene Dyes

General Structure:

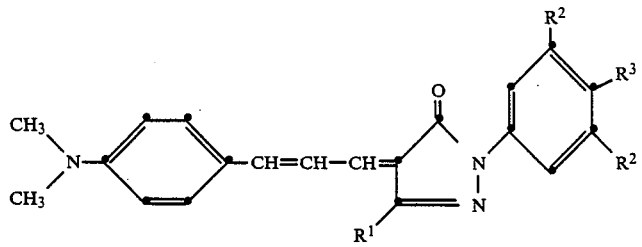

| Dye | $R^1$ | $R^2$ | $R^3$ | λ-max | ε-max (× $10^4$) (methanol) |
|---|---|---|---|---|---|
| 1 | $CH_3$ | H | $CO_2H$ | 516 | 4.62 |
| 2 | $CH_3CO$ | H | $CO_2H$ | 573 | 5.56 |
| 3 | $CO_2Et$ | H | $CO_2H$ | 576 | 5.76 |
| 4 | $CH_3$ | $CO_2H$ | H | 506 | 3.90 |
| 5 | $CO_2Et$ | $CO_2H$ | H | 560 | 5.25 |

TABLE II

Benzoylacetonitrile Merocyanine Dyes

General Structure:

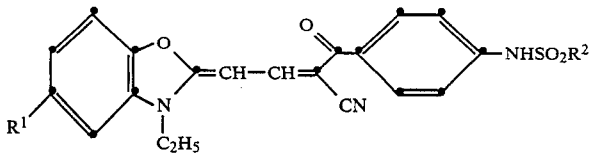

| Dye | $R^1$ | $R^2$ | λ-max | ε-max (× $10^4$) (methanol) |
|---|---|---|---|---|
| 6 | n-$C_6H_{13}SO_2NH$ | $CH_3$ | 445 | 7.32 |
| 7 | $CH_3SO_2NH$ | $C_3H_7$ | 446 | 7.86 |
| 8 | $CH_3SO_2NH$ | n-$C_6H_{13}$ | 447 | 7.6 |
| 9 | H | $CH_3$ | 449 | 6.5 |

TABLE II-A

Arylidene Dyes

General Structure:

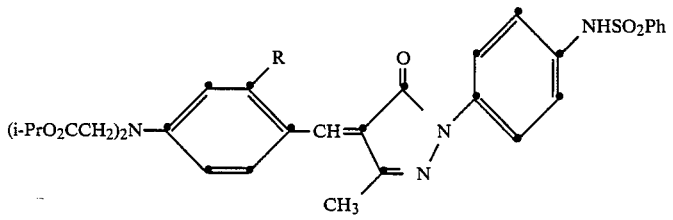

| Dye | R | λ-max | ε-max (× $10^4$) (methanol) |
|---|---|---|---|
| 10 | H | 424 | 3.98 |
| 11 | $CH_3$ | 423 | 3.86 |

TABLE III

Benzoylacetonitrile Arylidene Dyes

General Structure:

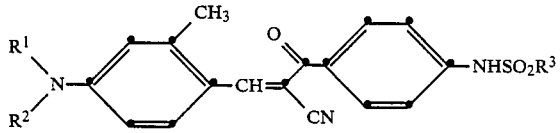

| Dye | $R^1$ | $R^2$ | $R^3$ | λ-max | ε-max (× $10^4$) (methanol) |
|---|---|---|---|---|---|
| 12 | i-$PrO_2CCH_2$ | i-$PrO_2CCH_2$ | $C_3H_7$ | 426 | 3.5 |
| 13 | $C_2H_5$ | $CF_3CH_2O_2CCH_2$ | $CH_3$ | 439 | 4.27 |
| 14 | i-$PrO_2CCH_2$ | i-$PrO_2CCH_3$ | $CH_3$ | 420 | 4.2 |
| 15 | $C_2H_5$ | $CF_3CH_2O_2CCH_2$ | $C_3H_7$ | 430 | 4.25 |

TABLE IV

Pyrazolone Merocyanines Dyes

General Structure:

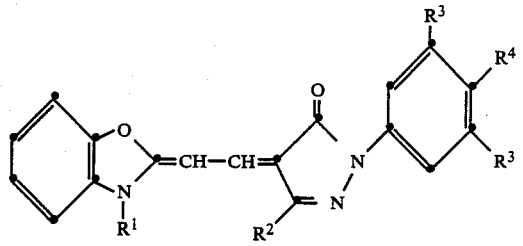

| Dye | $R^1$ | $R^2$ | $R^3$ | $R^4$ | λ-max | εmax (× $10^4$) (methanol) |
|---|---|---|---|---|---|---|
| 16 | $C_2H_5$ | $CH_3$ | H | $CO_2H$ | 450 | 7.4 |
| 17 | $C_2H_5$ | $CH_3$ | $CO_2H$ | H | 452 | 7.19 |

18

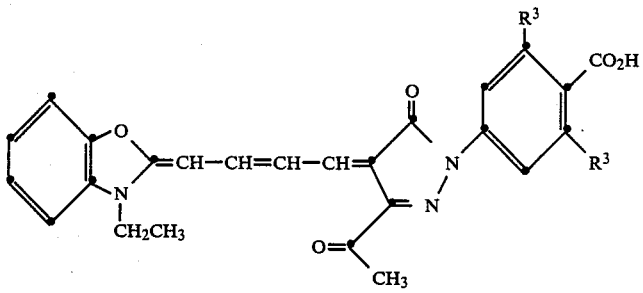

λ-max 562 nm (methanol) ε-max = 11.9 × $10^4$

TABLE V

Barbituric Acid Merocyanines Dyes

General Structure:

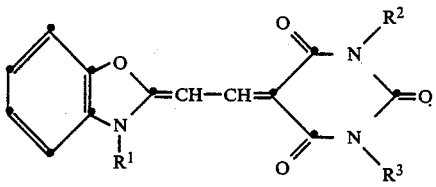

| Dye | $R^1$ | $R^2$ | $R^3$ | λ-max | ε-max (× $10^4$) (methanol) |
|---|---|---|---|---|---|
| 19 | $CH_2PhCO_2H$ | $C_2H_5$ | $C_2H_5$ | 442 | 10.70 |

TABLE VI

Benzoxazole Benzoylacetonitrile Merocyanine Dyes

General Structure:

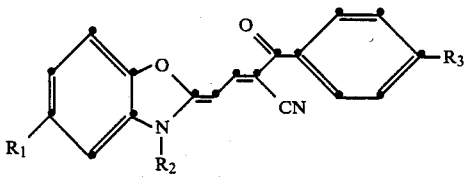

| Dye | $R^1$ | $R^2$ | $R^3$ |
|---|---|---|---|
| 20 | — | Et | $MeOEtSO_2NH$ |
| 21 | — | Me | $MeSO_2NH$ |
| 22 | $MeOEtSO_2NH$ | Et | $MeOEtSO_2NH$ |
| 23 | $MeOEtSO_2NH$ | Et | $HexSO_2NH$ |

TABLE VI-continued

Benzoxazole Benzoylacetonitrile Merocyanine Dyes

General Structure:

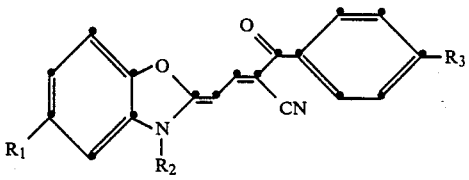

| Dye | $R^1$ | $R^2$ | $R^3$ |
|---|---|---|---|
| 24 | $MeSO_2NH$ | MeOEt | $MeSO_2NH$ |
| 25 | — | $CH_2PhCO_2H$ | $PrSO_2NH$ |
| 26 | $MeSO_2NH$ | MeOEt | $PrSO_2NH$ |
| 27 | $MeOEtSO_2NH$ | MeOEt | $PrSO_2NH$ |
| 28 | $EtSO_2NH$ | Et | $MeSO_2NH$ |
| 29 | $EtSO_2NH$ | Me | $MeSO_2NH$ |
| 30 | $MeOEtSO_2NH$ | MeOEt | $MeOEtSO_2NH$ |
| 31 | $HexSO_2NH$ | MeOEt | $MeSO_2NH$ |
| 32 | $MeOEtSO_2NH$ | MeOEt | $HexSO_2NH$ |
| 33 | — | $CH_2PhCO_2H$ | $MeSO_2NH$ |
| 34 | $MeSO_2NH$ | Me | $MeSO_2NH$ |
| 35 | $CO_2H$ | Me | $MeSO_2NH$ |
| 36 | $CO_2H$ | Me | $PrSO_2NH$ |
| 37 | $EtOEtOEtSO_2NH$ | Et | $MeSO_2NH$ |
| 38 | $EtOEtOEtSO_2NH$ | Et | $PrSO_2NH$ |
| 39 | $PrSO_2NH$ | Et | $MeSO_2NH$ |
| 40 | $PrSO_2NH$ | Me | $MeSO_2NH$ |
| 41 | $MeSO_2NH$ | Et | $EtSO_2NH$ |
| 42 | $EtSO_2NH$ | Et | $EtSO_2NH$ |
| 43 | $BuSO_2NH$ | Et | $MeSO_2NH$ |
| 44 | $BuSO_2NH$ | Et | $CO_2H$ |
| 45 | $BuSO_2NH$ | Me | $MeSO_2NH$ |
| 46 | $MeSO_2NH$ | Et | $BuSO_2NH$ |

TABLE VII
| Dye | Miscellaneous Dyes |
|---|---|
| 47 | 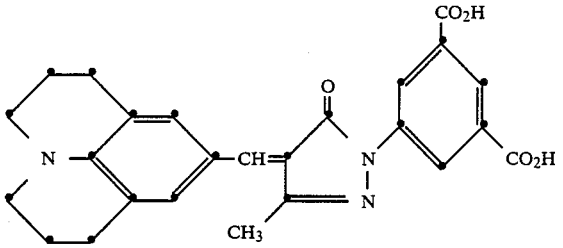 λ-max = 502 nm<br>ε-max = 5.47 × $10^4$ |
| 48 | 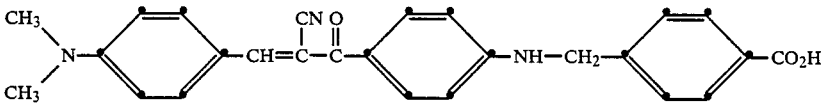 |
| 49 | 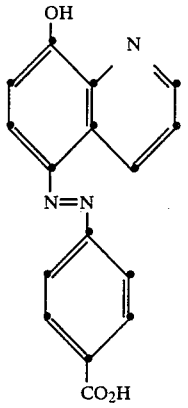 |
| 50 | 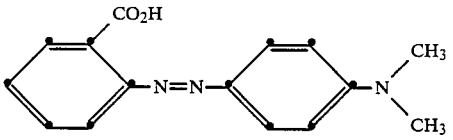 |
| 51 | 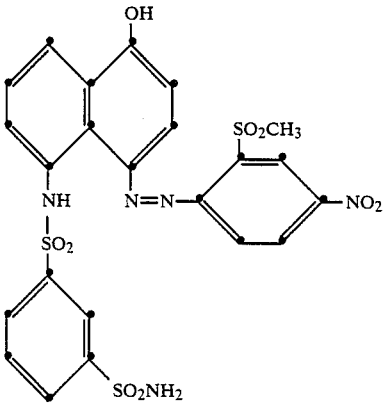 |

TABLE VII-continued
| Dye | Miscellaneous Dyes |
|---|---|
| 52 | 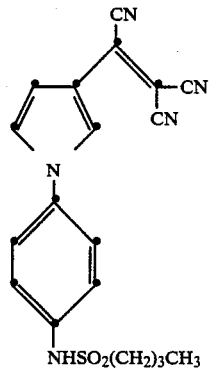 |
| 53 | 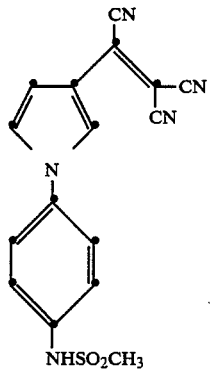 |
| 54 | 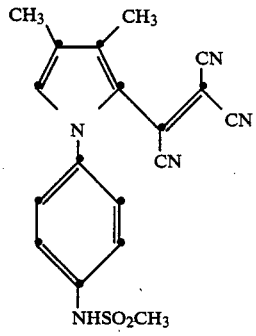 |
| 55 | 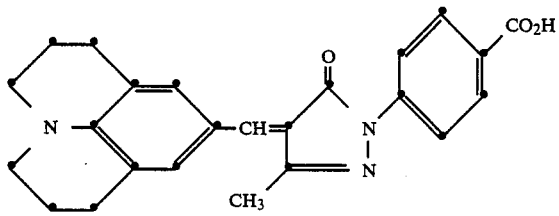 λ-max = 500 nm<br>ε-max = $5.82 \times 10^4$ |

TABLE VIII

Arylidene Dyes

General Structure:

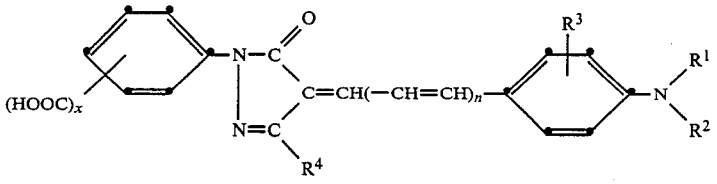

| Dye | $R^1$, $R^2$ | $R^3$ | $R^4$ | 1-Ph Substn. × Position | n | λ-max (nm) | ε-max $(10)^4$ |
|---|---|---|---|---|---|---|---|
| 56 | $CH_3$ | H | $CH_3$ | 1 4 | 0 | 466 | 3.73 |
| 57 | $C_2H_5$ | H | $CH_3$ | 1 4 | 0 | 471 | 4.75 |
| 58 | n-$C_4H_9$ | H | $CH_3$ | 1 4 | 0 | 475 | 4.50 |
| 59 | $CH_3$ | H | $COOC_2H_5$ | 1 4 | 0 | 508 | 5.20 |
| 60 | i-$C_3H_7OC(=O)CH_2$ | $CH_3$ | $CH_3$ | 1 4 | 0 | 430 | 3.34 |
| 61 | $CH_3$ | H | $CH_3$ | 2 3,5 | 0 | 457 | 3.78 |
| 62 | $C_2H_5$ | H | $CH_3$ | 2 3,5 | 0 | 475 | 4.55 |
| 63 | n-$C_4H_9$ | H | $CH_3$ | 2 3,5 | 0 | 477 | 4.92 |
| 64 | i-$C_3H_7OC(=O)CH_2$ | H | $CH_3$ | 2 3,5 | 0 | 420 | 3.62 |
| 65 | i-$C_3H_7OC(=O)CH_2$ | $CH_3$ | $CH_3$ | 2 3,5 | 0 | 434 | 3.25 |
| 66 | i-$C_3H_7OCCH_2$ | H | $CH_3$ | 1 4 | 0 | 420 | 3.94 |
| 67 | $CH_3$ | H | $C(=O)CH_3$ | 1 4 | 1 | 573 | 5.56 |
| 68 | $CH_3$ | H | COOEt | 1 3,5 | 0 | 502 | 4.83 |
| 69 | $C_2H_5$ | H | COOEt | 1 4 | 0 | 512 | 6.22 |
| 70 | $CH_3$ | H | $CF_3$ | 1 4 | 0 | 507 | 4.58 |
| 71 | $CH_3$ | H | Ph | 1 4 | 0 | 477 | 4.54 |
| 72 | $CH_3$ | H | $C(=O)CH_3$ | 1 4 | 0 | 506 | 5.36 |

TABLE IX

Oxazole and Oxazoline Pyrazolone Merocyanine Dyes

73

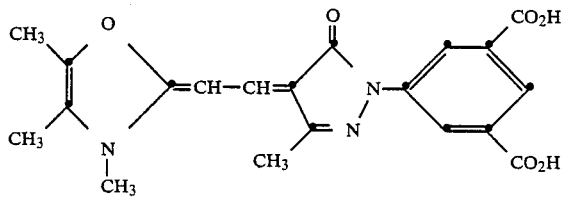

74

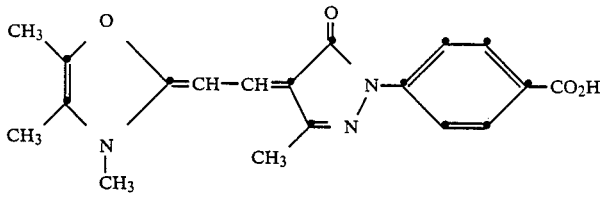

TABLE IX-continued
Oxazole and Oxazoline Pyrazolone Merocyanine Dyes
75
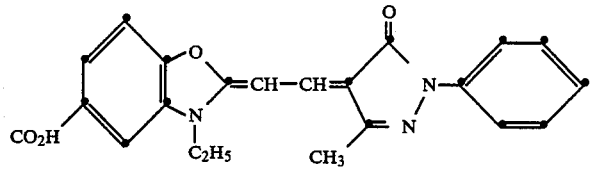
76
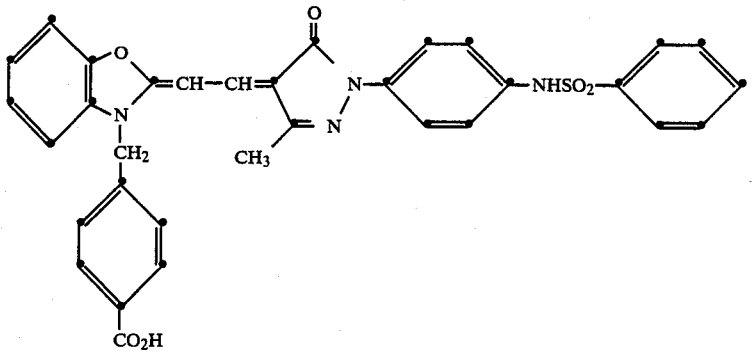
77
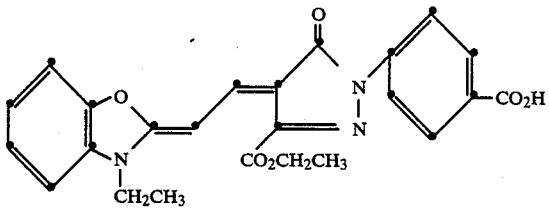
78
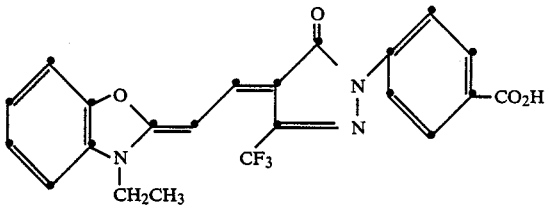
79
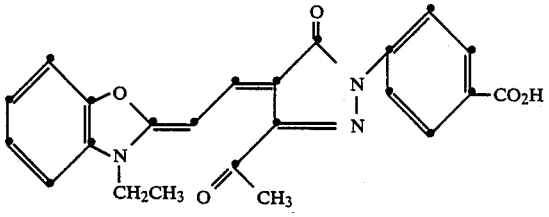
80
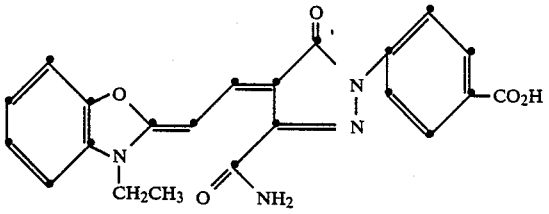

TABLE IX-continued
Oxazole and Oxazoline Pyrazolone Merocyanine Dyes
81
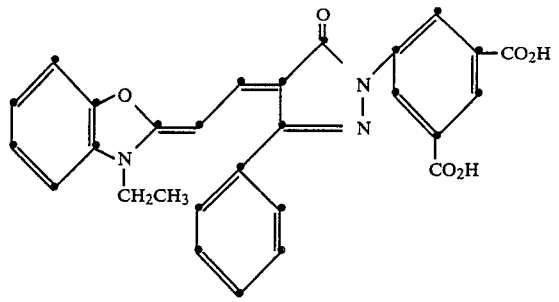
82
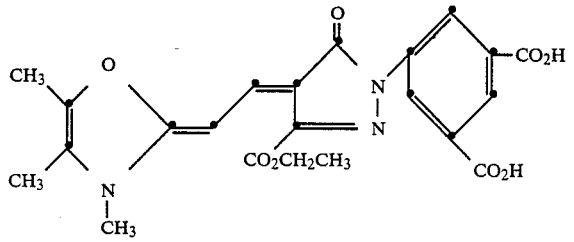
83
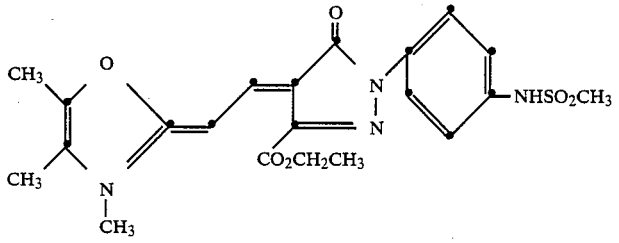
84
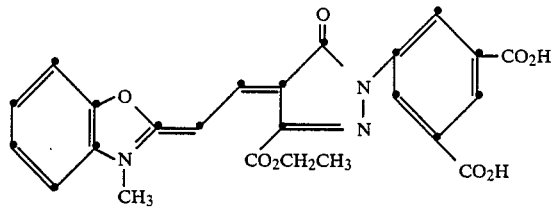
85
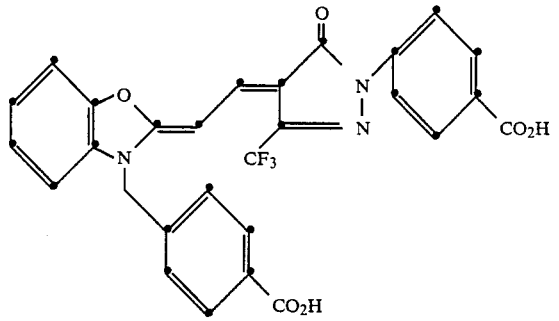

TABLE IX-continued
Oxazole and Oxazoline Pyrazolone Merocyanine Dyes
86
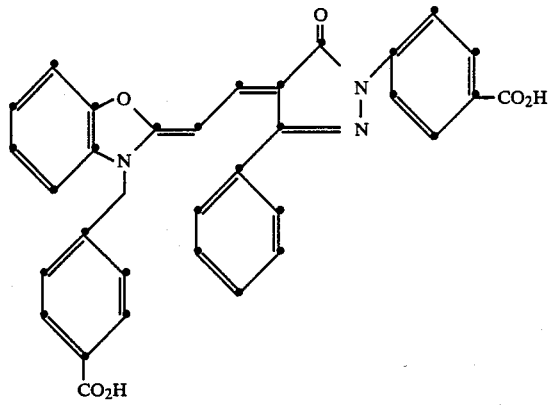
87
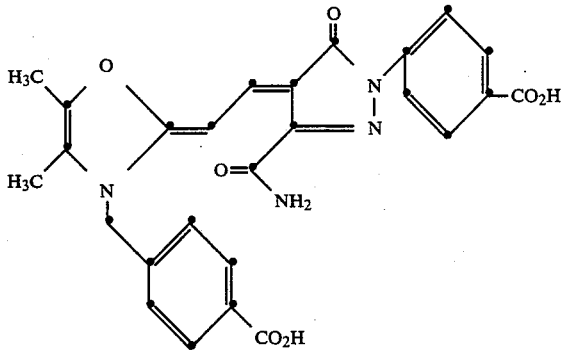
88
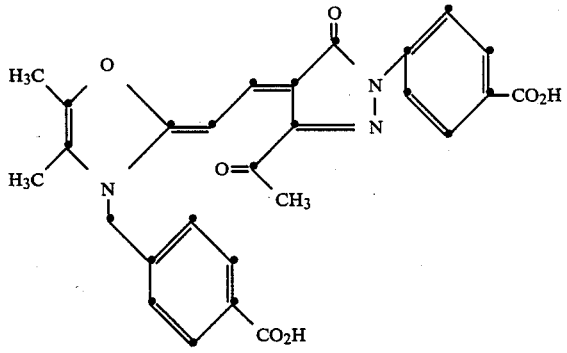
89
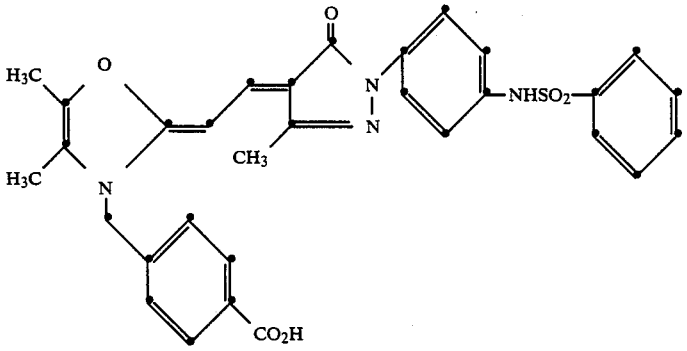

TABLE IX-continued
Oxazole and Oxazoline Pyrazolone Merocyanine Dyes
90
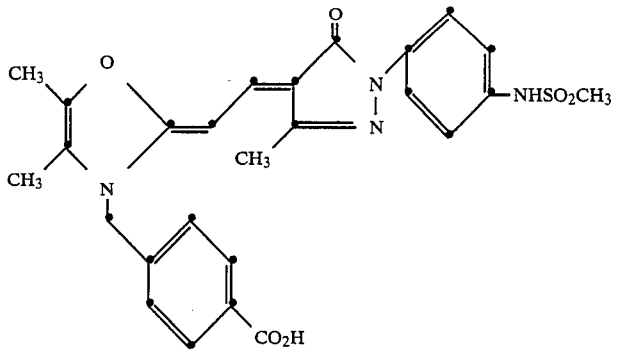
91
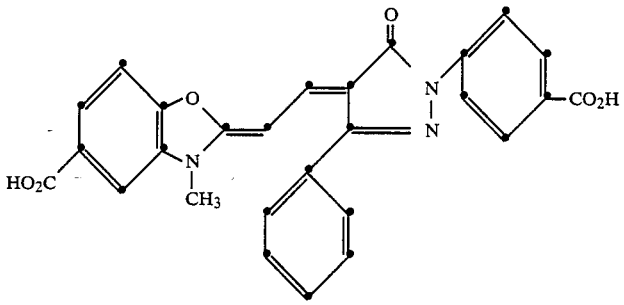
92
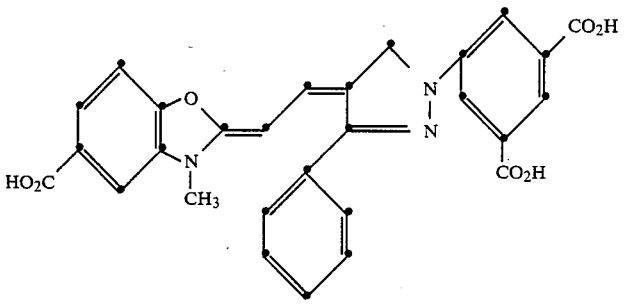
93
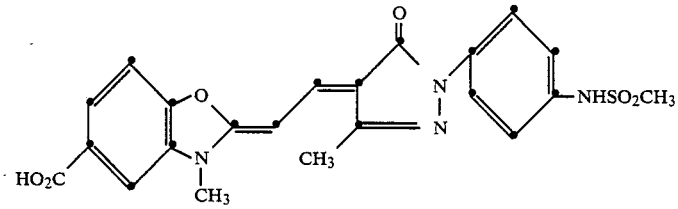
94
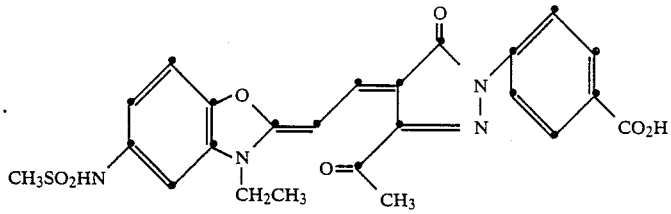

TABLE IX-continued
Oxazole and Oxazoline Pyrazolone Merocyanine Dyes
95
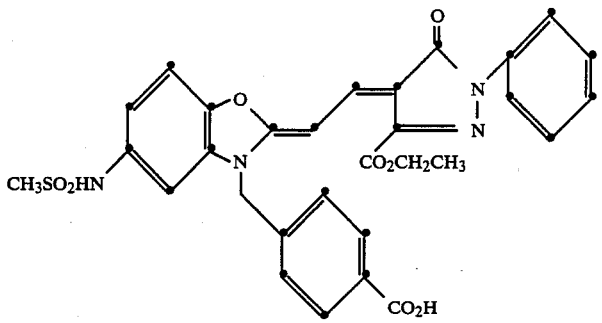
96
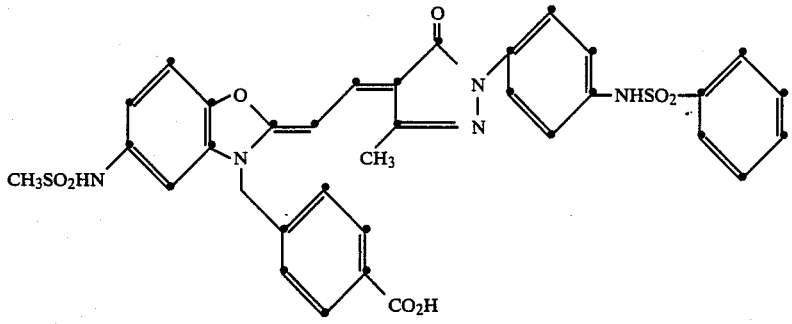
97
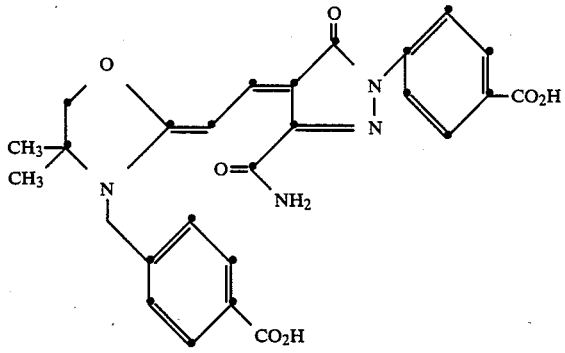
98
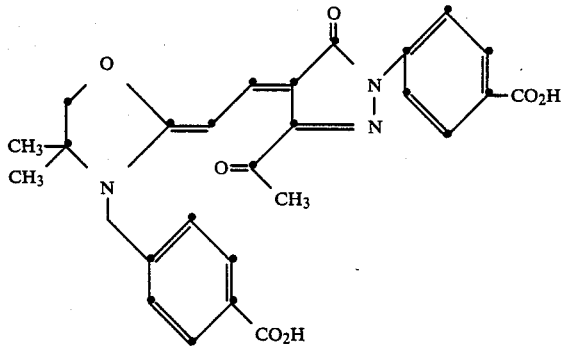

TABLE IX-continued
| Oxazole and Oxazoline Pyrazolone Merocyanine Dyes |
|---|
| 99 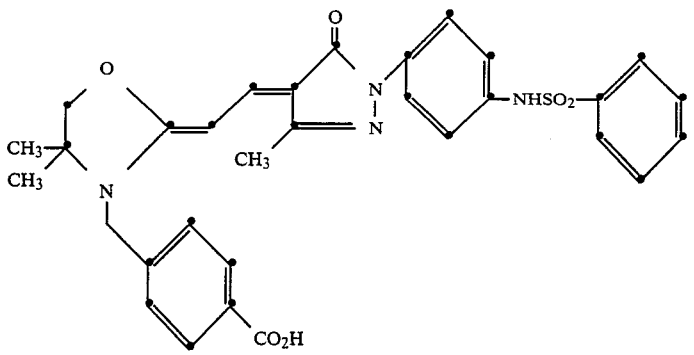 |
TABLE X
| Oxazole and Oxazoline Benzoylacetonitrile Merocyanine Dyes |
|---|
| 100 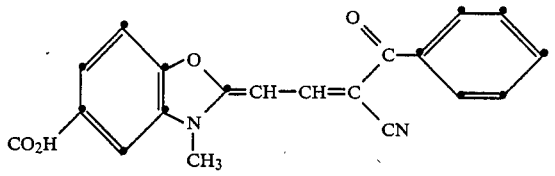 |
| 101 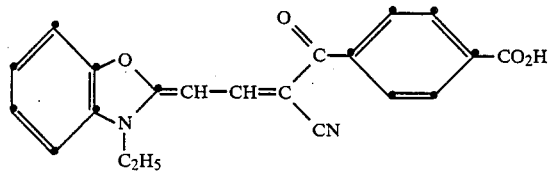 |
| 102 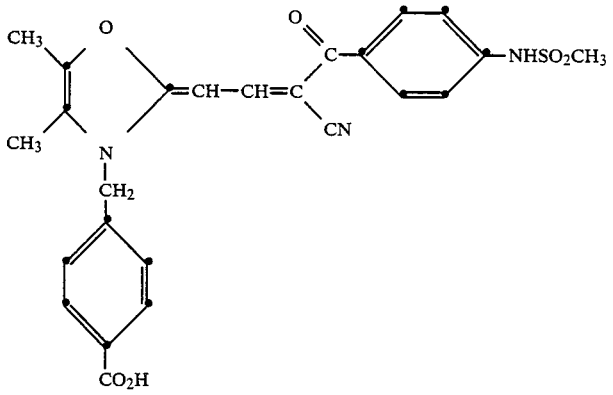 |

TABLE X-continued
Oxazole and Oxazoline Benzoylacetonitrile
Merocyanine Dyes
103
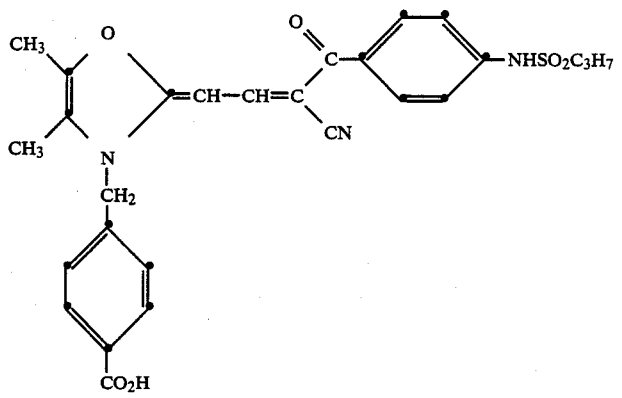
104
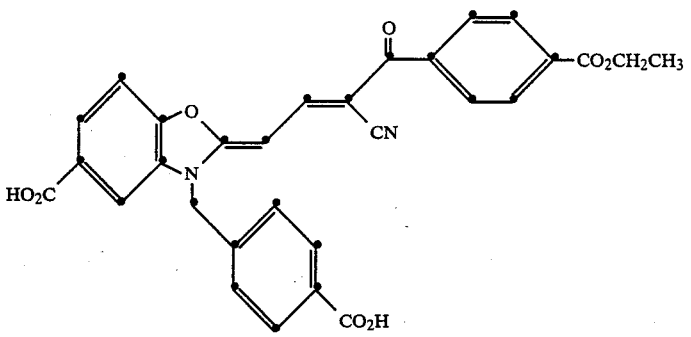
105
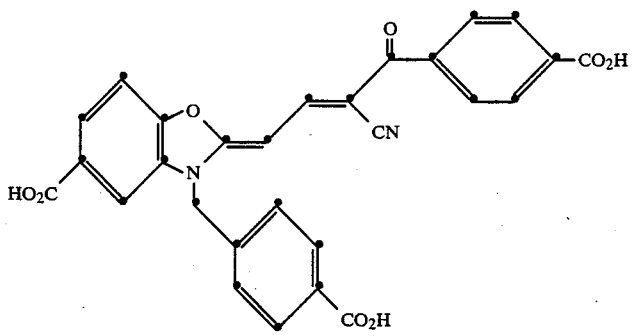
106
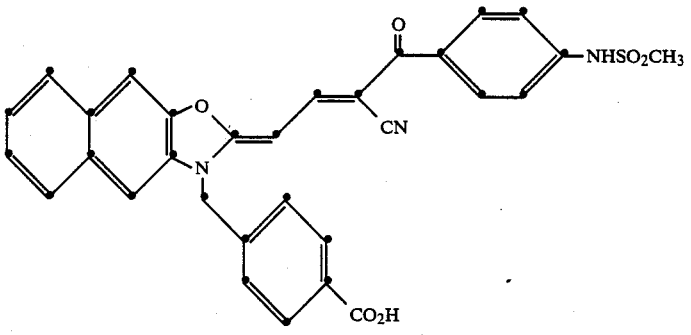

TABLE X-continued
Oxazole and Oxazoline Benzoylacetonitrile
Merocyanine Dyes
107
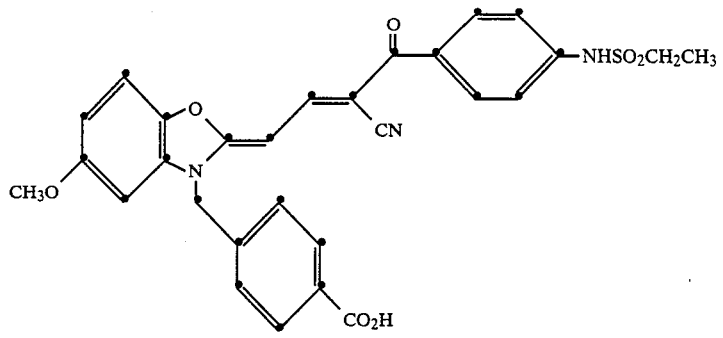
108
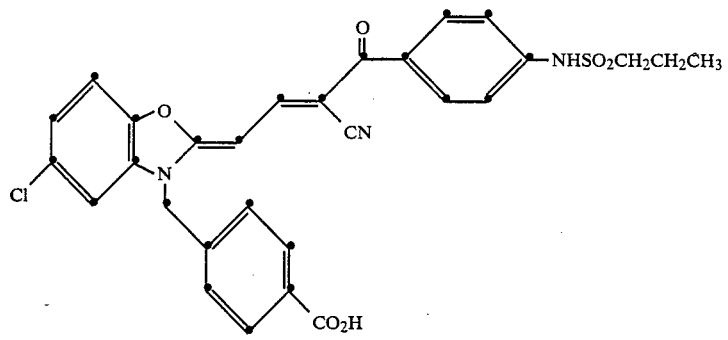
109
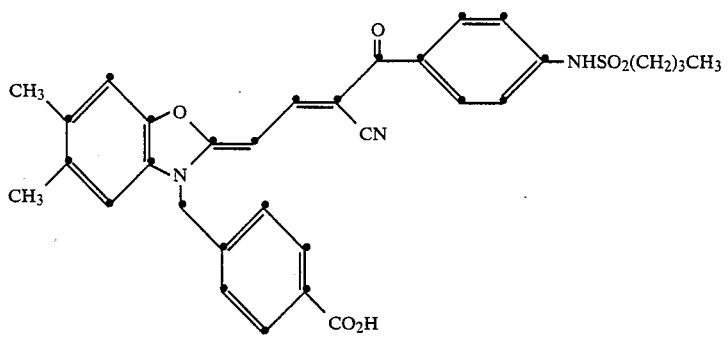
110
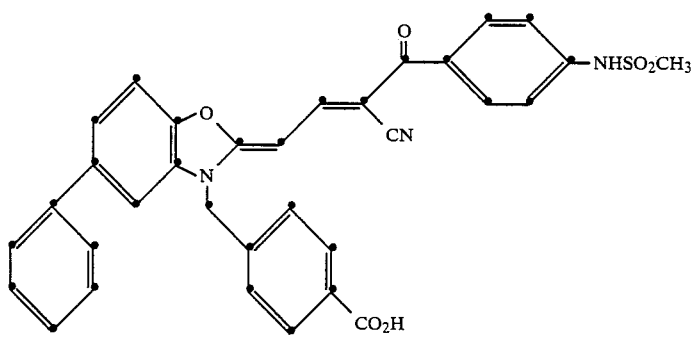

TABLE X-continued
| Oxazole and Oxazoline Benzoylacetonitrile Merocyanine Dyes | |
|---|---|
| 111 | 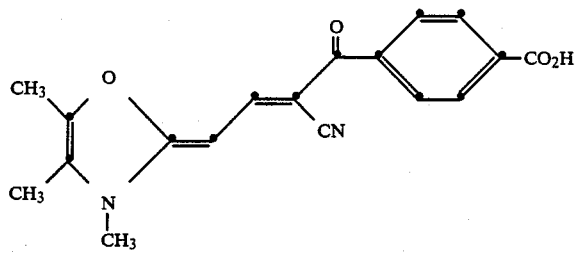 |
| 112 | 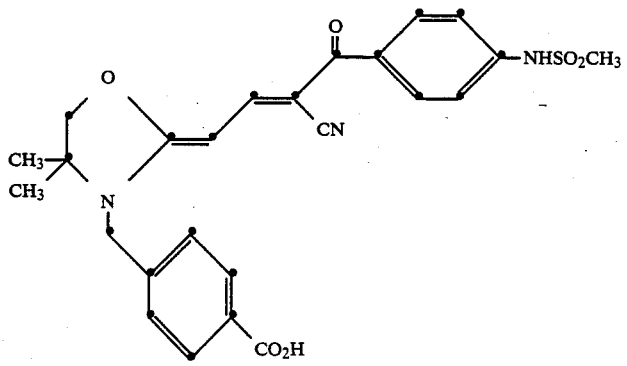 |
| 113 | 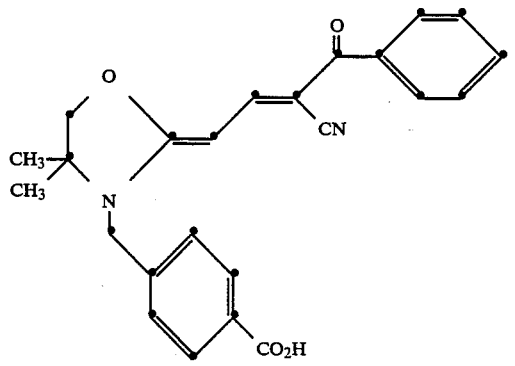 |
| 114 | 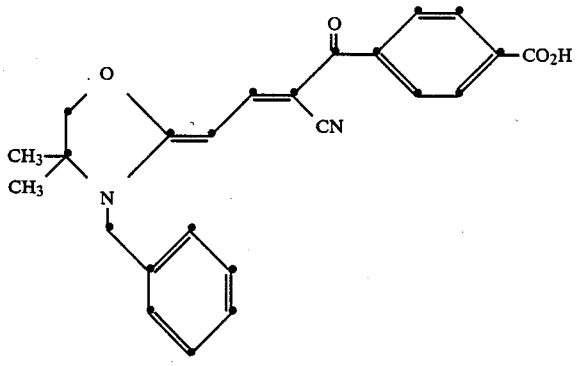 |
| 115 | 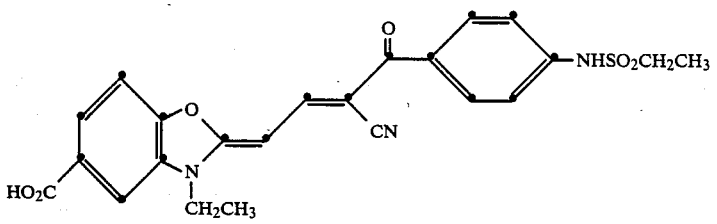 |

TABLE X-continued
| Oxazole and Oxazoline Benzoylacetonitrile Merocyanine Dyes |
|---|
| 116 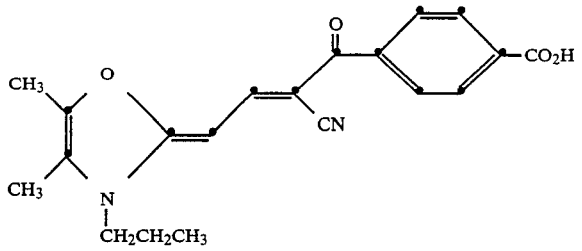 |
| 117 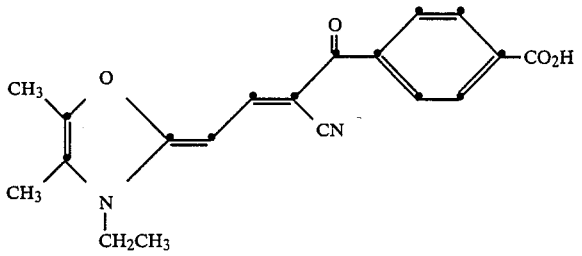 |
| 118 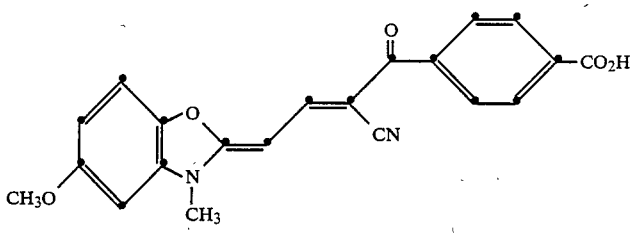 |
| 119 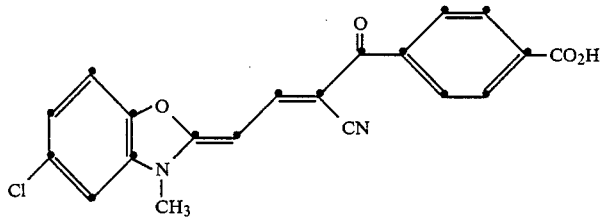 |
| 120 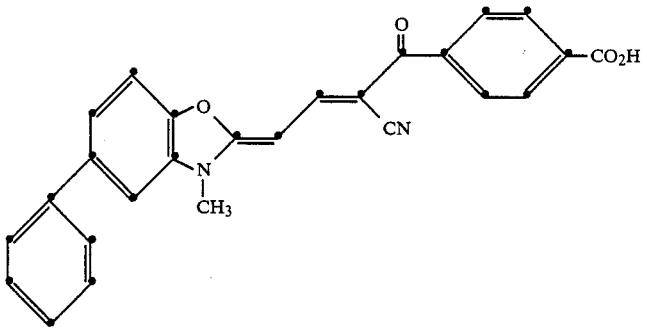 |
| 121 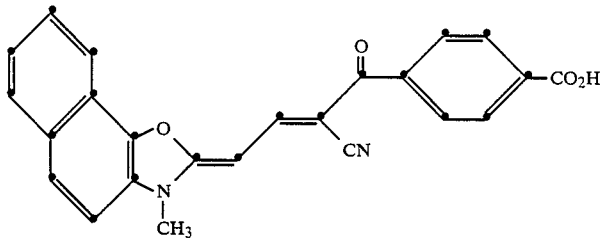 |

TABLE X-continued

Oxazole and Oxazoline Benzoylacetonitrile Merocyanine Dyes

122

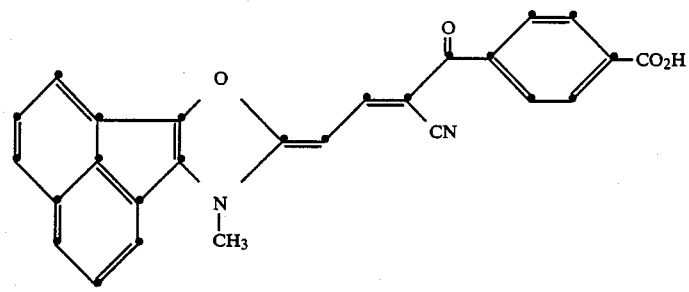

123

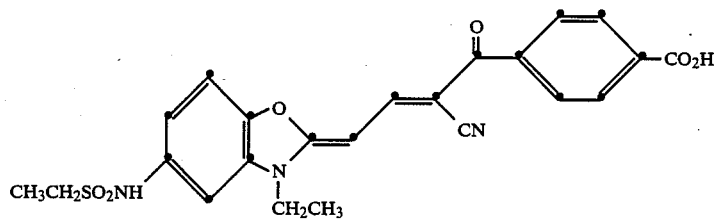

124

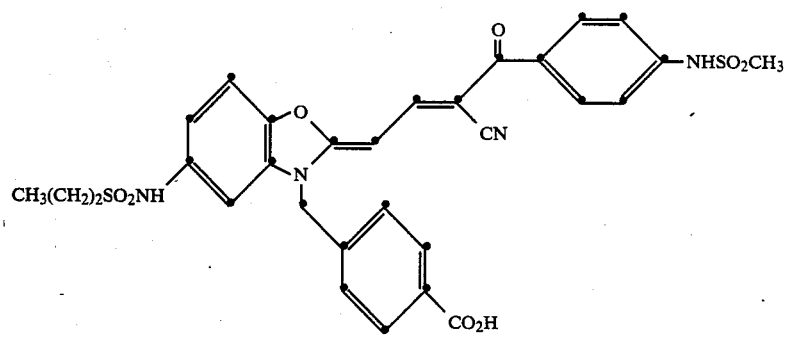

TABLE XI

Oxonol Dyes

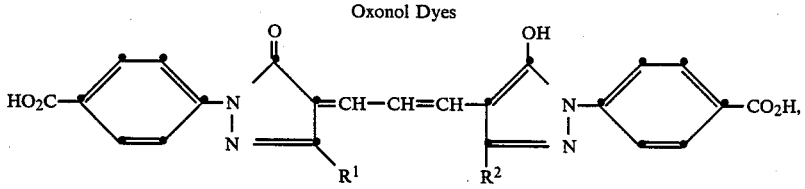

wherein

| Dye | $R^1$ | $R^2$ |
|---|---|---|
| 125 | $CH_3$ | $CH_3$ |
| 126 | $C_2H_5$ | $C_2H_5$ |

The dye can be added directly to the hydrophilic colloid as a particulate solid or can be converted to a particulate solid after it is added to the hydrophilic colloid. One example of the latter technique is to dissolve a dye which is not water soluble in a solvent which is water soluble. When the dye solution is mixed with an aqueous hydrophilic colloid, followed by noodling and washing of the hydrophilic colloid (see *Research Disclosure,* Item 17643, cited above, Section II), the dye solvent is removed, leaving particulate dye dispersed within the hydrophilic colloid. Thus, any water insoluble dye which that is soluble in a water miscible organic solvent can be employed as a particulate dye in the practice of the invention, provided the dye is susceptible to bleaching under processing conditions—e.g., at alkaline pH levels. Specific examples of contemplated water miscible organic solvents are methanol, ethyl acetate, cyclohexanone, methyl ethyl ketone, 2-(2-butoxyethoxy)ethyl acetate, triethyl phosphate, methylacetate, acetone, ethanol, and dimethylformamide. Dyes preferred for use with these solvents are sulfonamide substituted arylidene dyes, specifically preferred examples of which are set forth about in Tables IIA and III.

In addition to being present in particulate form and satisfying the optical density requirements set forth above, the dyes employed in the under layer units must be substantially decolorized on processing. The term "substantially decolorized" is employed to mean that the dye in the under layer units raises the minimum density of the radiographic element when fully processed under the reference processing conditions, stated above, by no more than 0.1, preferably no more than 0.05, within the visible spectrum. As shown in the examples below the preferred particulate dyes produce no significant increase in the optical density of fully processed radiographic elements of the invention.

As indicated above, it is specifically contemplated to employ a UV absorber, preferably blended with the dye in each of crossover reducing layers 111 and 113. Any conventional UV absorber can be employed for this purpose. Illustrative useful UV absorbers are those disclosed in *Research Disclosure,* Item 18431, cited above, Section V, or *Research Disclosure,* Item 17643, cited above Section VIII(C), both here incorporated by reference. Preferred UV absorbers are those which either exhibit minimal absorption in the visible portion of the spectrum or are decolorized on processing similarly as the crossover reducing dyes.

Overlying the under layer unit on each major surface of the support is at least one additional hydrophilic colloid layer, specifically at one halide emulsion layer unit comprised of a spectrally sensitized silver bromide or bromoiodide tabular grain emulsion layer. At least 50 percent (preferably at least 70 percent and optimally at least 90 percent) of the total grain projected area of the tabular grain emulsion is accounted for by tabular grains having a thickness less than 0.3 μm (preferably less than 0.2 μm) and an average aspect ratio of greater than 5:1 (preferably greater than 8:1 and optimally at least 12:1). Preferred tabular grain silver bromide and bromoiodide emulsions are those disclosed by Wilgus et al U.S. Pat. No. 4,434,226; Kofron et al U.S. Pat No. 4,439,530; Abbott et al U.S. Pat. Nos. 4,425,425 and 4,425,426; Dickerson U.S. Pat. No. 4,414,304; Maskasky U.S. Pat. No. 4,425,501; and Dickerson U.S. Pat. No. 4,520,098; the disclosures of which are here incorporated by reference.

Both for purposes of achieving maximum imaging speed and minimizing crossover the tabular grain emulsions are substantially optimally spectrally sensitized. That is, sufficient spectral sensitizing dye is adsorbed to the emulsion grain surfaces to achiever at least 60 percent of the maximum speed attainable from the emulsions under the contemplated conditions of exposure. It is known that optimum spectral sensitization is achieved at about 25 to 100 percent or more of monolayer coverage of the total available surface area presented by the grains. The preferred dyes for spectral sensitization are polymethine dyes, such as cyanine, merocyanine, hemicyanine, hemioxonol, and merostyryl dyes. Specific examples of spectral sensitizing dyes and their use to sensitize tabular grain emulsions are provided by Kofron et al U.S. Pat. No. 4,439,520, here incorporated by reference.

Although not a required feature of the invention, the tabular grain emulsions are rarely put to practical use without chemical sensitization. Any convenient chemical sensitization of the tabular grain emulsions can be undertaken. The tabular grain emulsions are preferably substantially optimally (as defined above) chemically and spectrally sensitized. Useful chemical sensitizations, including noble metal (e.g., gold) and chalcogen (e.g., sulfur and/or selenium) sensitizations as well as selected site epitaxial sensitizations, are disclosed by the patents cited above relating to tabular grain emulsions, particularly Kofron et al and Maskasky.

In addition to the grains and spectral sensitizing dye the emulsion layers can include as vehicles any one or combination of various conventional hardenable hydrophilic colloids alone or in combination with vehicle extenders, such as latices and the like. The vehicles and vehicle extenders of the emulsion layer units can be identical to those of the interlayer units. The vehicles and vehicle extenders can be selected from among those disclosed by *Research Disclosure,* Item 17643, cited above, Section IX, here incorporated by reference. Specifically preferred hydrophilic colloids are gelatin and gelatin derivatives.

The coating coverages of the emulsion layers are chosen to provide on processing the desired maximum density levels. For radiography maximum density levels are generally in the range of from about 3 to 4, although specific applications can call for higher or lower density levels. Since the silver images produced on opposite sides of the support are superimposed during viewing, the optical density observed is the sum of the optical densities provided by each emulsion layer unit. Assuming equal silver coverages on opposite major surfaces of the support, each emulsion layer unit should contain a silver coverage from about 18 to 30 mg/dm$^2$, preferably 21 to 27 mg/dm$^2$.

It is conventional practice to protect the emulsion layers from damage by providing overcoat layers. The overcoat layers can be formed of the same vehicles and vehicle extenders disclosed above in connection with the emulsion layers. The overcoat layers are most commonly gelatin or a gelatin derivative.

To avoid wet pressure sensitivity the total hydrophilic colloid coverage on each major surface of the support must be at least 35 mg/dm$^2$. It is an observation of this invention that it is the total hydrophilic colloid coverage on each surface of the support and not, as has been generally believed, simply the hydrophilic colloid coverage in each silver halide emulsion layer that controls its wet pressure sensitivity. Thus, with 10 mg/dm$^2$ of hydrophilic colloid being required in the interlayer unit for coating uniformity, the emulsion layer can contain as little as 20 mg/dm$^2$ of hydrophilic colloid.

To allow rapid access processing of the radiographic element the total hydrophilic coating coverage on each major surface of the support must be less than 65 mg/dm$^2$, preferably less than 55 mg/dm$^2$, and the hydrophilic colloid layers must be substantially fully forehardened. By substantially fully forehardened it is meant that the processing solution permeable hydrophilic colloid layers are forehardened in an amount sufficient to reduce swelling of these layers to less than 300 percent, percent swelling being determined by the following reference swell determination procedure: (a) incubating said radiographic element at 38° C. for 3 days at 50 percent relative humidity, (b) measuring layer thickness, (c) immersing said radiographic element in distilled water at 21° C. for 3 minutes, and (d) determining the percent change in layer thickness as compared to the layer thickness measured in step (b). This reference procedure for measuring forehardening is disclosed by Dickerson U.S. Pat. No. 4,414,304. Employing this reference procedure, it is preferred that the hydrophilic colloid layers be sufficiently forehardened that swelling is reduced to less than 200 percent under the stated test conditions.

Any conventional transparent radiographic element support can be employed. Transparent film supports, such as any of those disclosed in *Research Disclosure,* Item 17643, cited above, Section XIV, are all contemplated. Due to their superior dimensional stability the transparent film supports preferred are polyester supports. Poly(ethylene terephthalate) is a specifically preferred polyester film support. The support is typically tinted blue to aid in the examination of image patterns. Blue anthracene dyes are typically employed for this purpose. In addition to the film itself, the support is usually formed with a subbing layer on the major surface intended to receive the under layer units. For further details of support construction, including exemplary incorporated anthracene dyes and subbing layers, refer to *Research Disclosure,* Item 18431, cited above, Section XII.

In addition to the essential features of the radiographic elements of this invention set forth above, it is recognized that the radiographic elements can and in most practical applications will contain additional conventional features. Referring to *Research Disclosure,* Item 18431, cited above, the emulsion layer units can contain stabilizers, antifoggants, and antikinking agents of the type set forth in Section II, and the overcoat layers can contain any of variety of conventional addenda of the type set forth in Section IV. The outermost layers of the radiographic element can also contain matting agents of the type set out in *Research Disclosure, Item* 17643, cited above, Section XVI. Referring further to *Research Disclosure,* Item 17643, incorporation of the coating aids of Section XI, the plasticizers and lubricants of Section XII, and the antistatic layers of Section XIII, are each contemplated.

EXAMPLES

The invention is further illustrated by the following examples.

EXAMPLES 1-6

The following examples compare the performance of dual coated radiographic elements exposed using blue emitting thulium activated lanthanum oxybromide phosphor intensifying screens. The radiographic elements were identical, except for the choice of the crossover reducing materials employed between the emulsion layer and the support on each major surface.

The crossover reducing dye satisfying the requirements of the invention was yellow Dye 56 shown above in Table VIII. The dye was employed in a particulate form, the mean diameter of the dye particles being 0.8 μm.

Tartrazine Yellow (C.I. Acid Yellow 23-C.I. 13.065), hereinafter referred to as C-1, was selected as a control exemplary of dyes which are water soluble and nonbleachable taught by the art to be used as a crossover reducing dye in a dual coated radiographic element. To reduce wandering of the dye a cationic mordant poly(1-methyl-2-vinylpyridinium p-toluene sulfonate (hereinafter referred to as M-1) was used with the dye in a weight ratio of 5 parts of mordant per part of dye.

Carey Lea Silver, hereinafter referred to as CLS, was selected as a control exemplary of a particulate material which is neither water soluble nor bleachable under conditions compatible with silver imaging.

A series of dual coated radiographic elements identical, except for the choice and concentration of crossover reducing material listed below in Table XII, were prepared as follows:

Onto each side of a blue-tinted polyester film support was coated a gelatin hydrophilic colloid layer containing the crossover reducing material. The gelatin coating coverage was 11 mg/dm$^2$.

One control element was constructed with the same hydrophilic colloid layers, but without a crossover reducing material being present. This element is referred to as C—O.

An emulsion layer was coated over each hydrophilic colloid layer at a coverage of 22 mg/dm$^2$ silver and 22 mg/dm$^2$ gelatin. The emulsion was a high aspect ratio tabular grain silver bromide emulsion having a mean grain diameter of 1.8 μm. Tabular grains having a thickness of 0.16 μm and a mean diameter of at least 0.6 μm exhibited an average aspect ratio of 11.25:1 and accounted for greater than 70 percent of the total grain projected area.

Over each emulsion layer was coated a gelatin overcoat at a coverage of 9.1 mg/dm$^2$.

The hydrophilic colloid layers (including the emulsion layers) were hardened with bis(vinylsulfonylmethyl) ether at 1.0% of the gelatin weight.

To permit crossover determinations, samples of the dual coated radiographic elements were exposed with a single intensifying screen placed in contact with one emulsion layer. Black paper was placed against the other emulsion side of the sample. The X-radiation source was a Picker VTX653 3-phase X-ray machine, with a Dunlee High-Speed PX1431-CQ-150 kVp 0.7/1.4 mm focus tube.

Exposure was made at 70 kVp, 32mAs, at a distance of 1.40 m. Filtration was with 3 mm Al equivalent (1.25 inherent+1.75 al); Half Value Layer (HVL)−2.6 mm Al. A 26 step Al wedge was used, differing in thickness by 2 mm per step.

Processing of the exposed film was in each instance undertaken using a processor commercially available under the trademark Kodak RP X-Omat Film Processor M6 or M8, both employing the reference processing conditions set forth above.

The density of the silver developed in each of the silver halide emulsion layers, the emulsion layer adjacent the intensifying screen, and the non-adjacent emulsion layer separated from the intensifying screen by the film support, was determined. By plotting density produced by each emulsion layer versus the steps of the step-wedge (a measure of exposure), a sensitometric curve was generated for each emulsion layer. A higher density was produced for a given exposure in the emulsion nearest the intensifying screen. Thus, the two sensitometric curves were offset in speed. At three different density levels in the relatively straight line portions of the sensitometric curves between their toe and shoulders the difference in speed (Δ log E) between the two sensitometric curves was measured. These differences were then averaged and used in the following equation to calculate percent crossover:

$$\% \text{ Crossover} = \frac{1}{\text{antilog}(\Delta \log E) + 1} \times 100$$

Percent crossover is reported in Table XII below.

Relative speed reported in Table XII is the speed of the emulsion layer nearest the support.

TABLE XII

Figure 2:
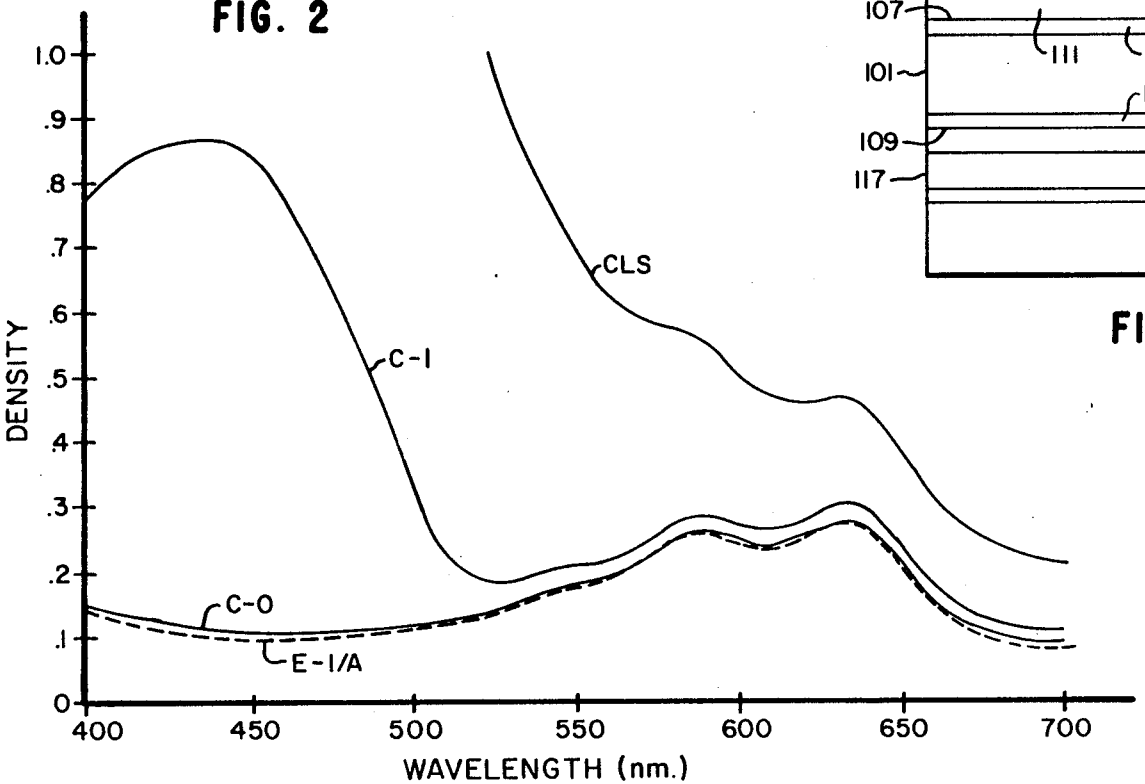

| Crossover Reducer (mg/sq.$^2$ dm) | % Crossover | Relative Speed | Stain (FIG. 2) |
|---|---|---|---|
| None | 20 | 70 | C-0 |
| (0.7) 56 (Example) | 11 | 59 | |
| (0.7) CLS (Control) | 3 | 59 | |
| (0.7) C-1 (Control) | 9 | 52 | |
| (1.4) 56 (Example) | 6 | 56 | E-1/A |
| (1.4) CLS (Control) | 3 | 61 | CLS |
| (1.4) C-1 (Control) | 5 | 51 | C-1 |

All of the crossover reducing materials of Table XII were shown capable of reducing crossover below 10 percent. Dye 56 at a coating coverage of 0.7 mg/dm$^2$ exhibited an optical density of a single layer of 0.91, resulting in a crossover of 11 percent. It is therefore apparent that when the coating coverage of Dye 56 is raised to provide a single layer optical density of 1.0 or more a crossover of less than 10 percent can be readily achieved. The Dye 56 at a coating coverage of 1.4 mg/dm$^2$ exhibited a single layer optical density of 1.6.

The mordanted water soluble dye C-1 and the CLS both gave unacceptable results, since in neither instance did bleaching occur on processing. Further, the dye C-1 by reason of its wandering characteristic reduced photographic speed significantly, even though it was incorporated with a mordant to prevent wandering.

Dye 56 was entirely decolorized during processing. From FIG. 2 it can be seen that the density of the element after processing was essentially similar to the element lacking a crossover reducing material. At the same time the capability of crossover reduction below 10 percent was demonstrated. Some loss of photographic speed was observed, but it is to be noted that, since the purpose of a crossover reducing agent is to prevent a portion of the light emitted by the screens from exposing the emulsion layers, some reduction in photographic speed is inherent in crossover reduction.

This example demonstrates the satisfactory performance of a bleachable particulate dye to reduce crossover without producing dye stain in the processed radiographic element and with only minimal impact on imaging speed. The control crossover reducing materials were unacceptable because of their high dye stain, and the control dye was unacceptable in producing an increased loss in imaging speed.

EXAMPLES 7–12

The procedure of Examples 1 through 6 was repeated, except that magenta dyes were substituted for testing; the emulsion layer was substantially optimally spectrally sensitized with 400 mg/Ag mole of the green spectral sensitizing dye anhydro-5,5'-di-chloro-9-ethyl-3,3'-di(3-sulfopropyl)oxacarbocyanine hydroxide, sodium salt; and green emitting intensifying screens, Kodak Lanex Regular® screens, were employed.

The dye satisfying the requirements of the invention was magenta Dye 59 shown above in Table VIII. The dye was employed in a particulate form, the mean diameter of the dye particles being 0.2 μm.

Acid Magenta (C.I. Acid Violet 19-C.I. 42,685), hereinafter referred to as C-2, was selected as a control exemplary of dyes which are water soluble and bleachable taught by the art to be used as a crossover reducing dye in a double coated radiographic element. To reduce wandering of the dye the cationic mordant M-1 was employed in a 5 parts mordant to 1 part dye weight ratio.

1,3-Bis[1-(4-sulfonylphenyl)-3-carboxy-2-pyraxolin-5-one-4] trimethine oxonol, disodium salt, hereinafter referred to as C-3, was selected as a control exemplary of magenta dyes which are water soluble and non-bleachable. Dye C-3 differed from dye 10 disclosed on page 5 of U.K. Pat. Spec. 1,414,456 only in that the nuclei were joined by 3 methine groups instead of 5 (to shift absorption into the desired green spectral region). To reduce wandering of the dye cationic mordant M-1 was again employed in a 5 parts mordant to 1 part dye weight ratio.

The results are summarized below in Table XIII.

TABLE XIII

Figure 3:
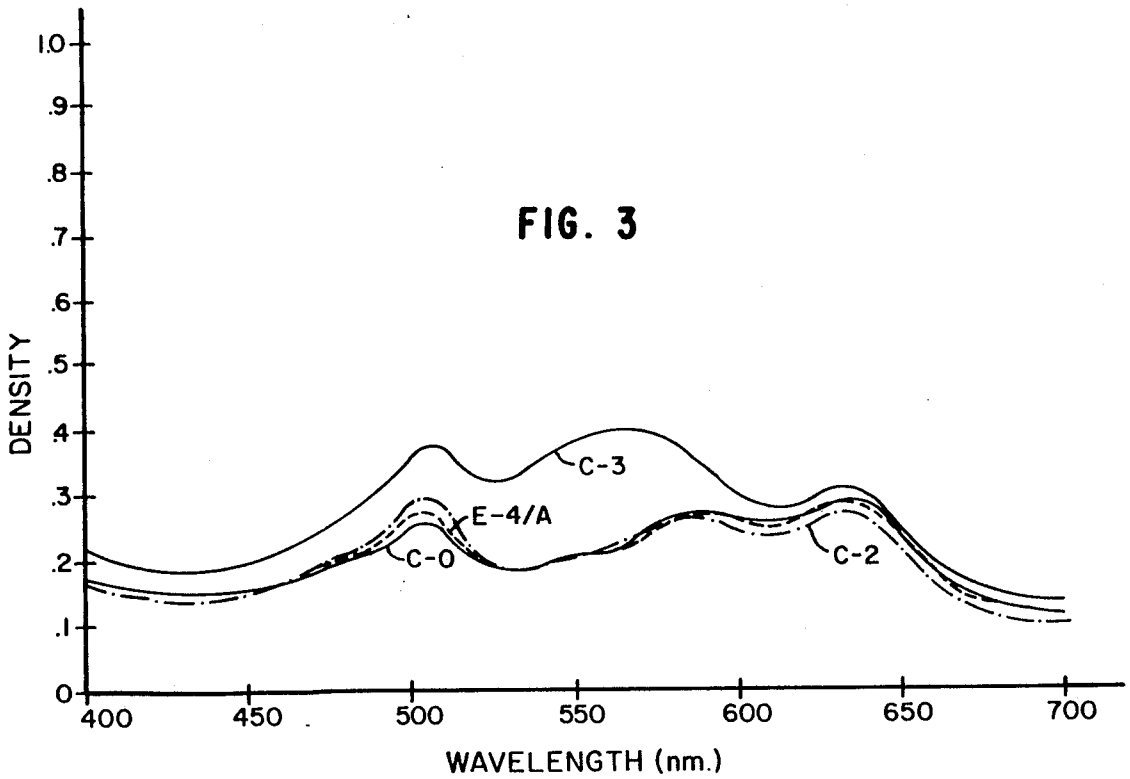

| Crossover Reducer (mg/sq.$^2$ dm) | % Crossover | Relative Speed | Stain (FIG. 3) |
|---|---|---|---|
| None | 19 | 113 | C-0 |
| (0.45) 59 (Control) | 11 | 101 | |
| (0.45) C-2 (Control) | 19 | 92 | |
| (0.45) C-3 (Control) | 14 | 98 | |
| (0.9) 59 (Example) | 7 | 97 | E-4/A |
| (0.9) C-2 (Control) | 15 | 87 | C-2 |
| (0.9) C-3 (Control) | 10 | 91 | C-3 |

From Table XIII it is apparent that the control crossover reducing dyes were inferior, both in terms of relatively lower crossover reduction and in terms of relatively greater speed loss imparted. Dyes 59A and C-2 exhibited essentially similar bleaching characteristics. The dye C-3 produced a significantly higher dye stain.

EXAMPLES 13–19

In these examples a series of radiographic elements otherwise satisfying the requirements of the invention, but varied first in the degree of hardening undertaken and then in the gelatin coating coverage of the green sensitized silver bromide tabular grain emulsion layers, were prepared to demonstrate the correlation between percent swell of the hydrophilic colloid layers using the reference swell procedure set forth above and the ability to achieve satisfactory drying of the radiographic elements during rapid access processing, using the reference processing conditions, also set forth above.

In every instance the under layer contained a gelatin coating coverage of 16.1 mg/dm$^2$ and a gelatin overcoat layer gelatin coverage 6.7 mg/dm$^2$, with the emulsion layer gelatin content being varied to obtain the total gelatin per side coating coverage given. The under coat layer contained in addition to the gelatin a combination of yellow and magenta particulate dyes Dye 56 and Dye 59, each at a coating coverage of 1.6 mg/dm$^2$. The hardener bis(vinylsulfonylmethyl)ether (BVSME) was employed in the percent by weight, based on total gelatin, indicated. The results are summarized in Table XIV.

TABLE XIV

| Element | Total Gelatin (mg/sq. dm) | % BVSME | % Dryer | Covering Power | % Swell |
|---|---|---|---|---|---|
| Control | 51.3 | 0.25 | >100 | 10.9 | 445 |
| Control | 51.3 | 0.5 | 90 | 8.6 | 315 |
| Example | 51.3 | 1 | 70 | 8.1 | 220 |
| Example | 51.3 | 1.5 | 60 | 8.2 | 181 |
| Example | 51.3 | 2.5 | 50 | 8.2 | 178 |

The processing characteristics of the first listed control radiographic element was unacceptable, since the radiographic element emerged from the processor still wet to the touch. The second listed control radiographic element was also unacceptable, since, though it dried after traversing 90 percent of the drying path in the rapid access processor, there was not sufficient safety margin to assure that the radiographic element would emerge from the processor dry to the touch under all actual conditions of use. Table XIV thus very clearly demonstrates the importance of reducing the percent swell below 300 percent.

Table XIV also demonstrates the maintenance of covering power levels by the tabular grain emulsions with progressively higher levels of hardening. Covering power is reported as 100 times the ratio of maximum density to developed silver, expressed in grams per square decimeter.

Additional coatings were prepared as described above and as reported in Table XV to show that increasing the amount of gelatin increases the percent swell and increases the percentage of the dryer required to produce a fully dried processed radiographic element. Thus, the total hydrophilic colloid coating coverage per side of the support is also of importance.

TABLE XV

| Element | Total Gelatin (m/sq. dm) | % BVSME | % Dryer | Covering Power | % Swell |
|---|---|---|---|---|---|
| Example | 51.3 | 1 | 70 | 8.1 | 220 |
| Example | 54.0 | 1 | 70 | 8.2 | 256 |
| Example | 59.9 | 1 | 80 | 8.2 | 266 |

EXAMPLES 20–30

From the preceding examples it is apparent that both the percent swell of the hydrophilic colloid layers and the total coating coverage of hydrophilic colloid per side of the support must be limited in order to remain within the drying capabilities of a rapid access processor. These examples demonstrate that reducing the total hydrophilic colloid coverage per side below 35 mg/dm$^2$ results in unacceptable wet pressure sensitivity levels.

A series of radiographic elements were prepared similarly as in Examples 13–19, except that percent of BVSME hardener was held constant at 1 percent by weight and the hydrophilic colloid coverage in the under layer (UL) and the emulsion layer (EL) on each side of the support was varied. In some coatings the under layer was omitted entirely. These elements were, of course, unacceptable for lacking the particulate dye required for crossover reduction. The overcoat layer gelatin coating coverage remained constant at 6.7 mg/dm$^2$.

Processing was conducted according to the reference processing procedure, but surfaces of the elastomer transport rollers in the rapid access processor were in this instance roughened by grinding to increase localized pressure on the radiographic elements during transport. This simulates the adverse results that are observed in actual use when a transport roller is in less than optimum adjustment.

Wet pressure sensitivity is reported as a ranking, with the ranking of 1 indicating no observable increase in graininess of the fully processed element and the ranking of 5 indicating the greatest manifestation of graininess. At the ranking level of 5 the user would find the graininess clearly objectionable. At the ranking level of 4 the user would readily notice the graininess. Thus, radiographic elements exhibiting wet pressure sensitivity levels of 4 or 5 would in most instances be considered below marketable quality. At the ranking level of 3 the radiographic elements were considered to be marginally acceptable. At the ranking level of 2 probably only one looking for a graininess deficiency in the radiographic image would be aware of it.

The results are summarized in Table XVI.

TABLE XVI

| Element | Gelatin (mg/sq. dm) UL | EL | total | % Dryer | Wet pressure Sens. Ranking |
|---|---|---|---|---|---|
| Example | 16.1 | 23.1 | 45.9 | 70 | 3 |
| Example | 16.1 | 25.8 | 48.6 | 70 | 2 |
| Example | 16.1 | 28.5 | 51.3 | 70 | 1 |
| Example | 16.1 | 31.5 | 54.3 | 80 | 1 |
| Example | 16.1 | 33.9 | 56.7 | 80 | 1 |
| Example | 16.1 | 37.1 | 59.9 | 80 | 1 |
| Example | 13.5 | 28.5 | 48.5 | 70 | 2 |
| Example | 10.8 | 28.5 | 46.0 | 70 | 2 |
| Control | None | 23.1 | 29.8 | <35 | 5 |
| Control | None | 25.8 | 32.5 | <35 | 4 |

When the total gelatin per side was raised from 32.5 to 35.2 mg/dm$^2$, the wet pressure sensitivity ranking increased from 4 to 3—that is, from unacceptable wet pressure sensitivity to marginally acceptable wet pressure sensitivity.

It is important to note that the same coating coverages in the emulsion layers which produce unacceptable wet pressure sensitivity in the absence of the under layer produce acceptable wet pressure sensitivity with the under layer present. This demonstrates that it is to total hydrophilic colloid coverage per side rather than the hydrophilic colloid content of the emulsion layer alone that is responsible for controlling wet pressure sensitivity.

It should be noticed further that the highest wet pressure sensitivity ranking of 1 requires 80 percent of the dryer. Thus, it is clear that the maximum hydrophilic colloid coverage per side must be limited, as demonstrated above.

APPENDIX

A-1. Preparation of Dye 6

Step 1—Preparation of Intermediate A

To a solution of 29.6 g of 5-amino-2-methylbenzoxazole in 100 ml pyridine cooled to 0° C. was added 41.3 g hexanesulfonyl chloride. After 1 hour stirring at 0° C., a reddish precipitate formed. The reaction mixture was stirred at room temperature for 2 days and then poured into 1.4 l of water and stirred for 2 hours. A heavy oil deposited and the supernatant was decanted. The oil was dissolved in 1.0 l dichloromethane, which was extracted with 4×200 ml of 1N hydrochloric acid, then dried over magnesium sulfate. The solvent was removed, leaving a reddish brown liquid of 5-hexylsulfonamido-2-methylbenzoxazole (Intermediate A).

Step 2—Preparation of Intermediate B

A mixture of 60 g of Intermediate A and 44 g ethyl p-toluenesulfonate was heated in a round bottom flask at 150° C. for 5 minutes. Upon cooling to room temperature, the crude brown mass was almost solidified. The product was dissolved in 25 ml methanol and poured into 300 ml diethyl ether with rapid stirring for 1 hour. The solid precipitate was chilled at 2° C. overnight, and then filtered. The tan powder was thoroughly washed with ether and recrystallized from 200 ml hot isopropyl alcohol to yield 23.4 g of 3-ethyl-5-hexylsulfonamido-2-methylbenzoxazolium p-toluenesulfonate (Intermediate B).

Step 3—Preparation of Intermediate C

A combination of 10 g Intermediate B and 8 g N,N-diphenylformamidine was thoroughly mixed and heated with stirring at 150°-160° C. for 25 minutes. The flask was then fitted with a condenser and 50 ml hot acetone was cautiously added. An orange precipitate formed. The flask was removed from the heat, cooled, and chilled in ice. After 1 hour, the reddish precipitate was filtered off and discarded. The filtrate was poured into 300 ml diethyl ether and stirred for 2 hors. The resulting yellow-orange powder was filtered, washed with ether, and dried to yield 10.6 g of 2-(2-anilinovinyl)-3-ethyl-5-hexylsulfonamidobenzoxazolium p-toluenesulfonate (Intermediate C).

Step 4—Preparation of Dye 6

A mixture of 2.7 g of Intermediate C, 15 ml ethanol, 0.54 g acetic anhydride, and 0.7 ml triethylamine was heated at reflux for 1 minute. Then 1.2 g 4-methylsulfonamidobenzoylacetonitrile (prepared according the procedure disclosed in Kreuger et al U.S. Patent No. 4,420,555) and 0.8 ml triethylamine were added and the mixture was heated at reflux for 2 minutes. The mixture was then chilled in ice for 30 minutes. The yellow-orange precipitate that had formed was filtered, washed with isopropyl alcohol and diethyl ether, then air dried to yield 1.17 g of crude dye. The reaction was repeated twice more to obtain a total of 3.0 g of crude dye, which was dissolved in 250 ml hot acetone, which was stirred with 10 g Amberlyst-15® ion exchange resin for 3 hours, heated for 15 minutes to reflux, then filtered while hot. The filtrate was chilled to 2° C. overnight and the resulting yellow precipitate was air dried to yield 2.3 g of Dye 6. The dye had a melting point of 297°-298° C., λ-max=442 nm (methanol), $\epsilon=7.32\times10^4$. The pKa's of this dye was measured by acid titration in a 50/50 (volume basis) mixture of ethanol and water and was determined to be 8.1 for the methylsulfonamido substituent and 9.2 for the hexylsulfonamido substituent. The log P was determined to be 4.66.

A-2. Preparation of Dye 7

Step 1—Intermediate D

To a solution of 5-amino-2-methylbenzoxazole (14.8 g) in 50 ml pyridine cooled to 0° C. was added methane sulfonylchloride (12.5 g). The mixture was stirred at room temperature under nitrogen. After three days of stirring, a tan precipitate had formed. The mixture was then poured into 800 ml ligroin P950 and stirred for 2 hours. The solid in the mixture was dissolved in 400 ml $CH_2Cl_2$, washed with 4×100 ml $H_2O$ with the water back extracted with 100 ml $CH_2Cl_2$, combined with the organic layers, dried over $MgSO_4$, filtered, and concentrated in vacuo to a tan brown solid. The solid was dissolved in 125 ml hot methanol, added to 25 ml isopropyl alcohol, chilled at 2° overnight filtered, washed with diethyl ether, and air dried to yield 15.2 g 2-methyl-5-methyl-5-methylsulfonamidobenzoxazolium iodide (intermediate D).

Step 2—Intermediate E

Intermediate D (4.52 g) and ethyl p-toluenesulfonate (4.4 g) were combined in a large test tube and heated over a hot air gun with manual stirring for 5 minutes. A brownish melt formed, which solidified to a glass on cooling to room temperature. The glass was dissolved in 50 ml hot methanol, diluted with an 100 ml hot ethanol, and 9.0 g tetrabutylammonium iodide dissolved in 20 ml ethanol was added. The brown, clear solution was cooled to room temperature and then ice cooled for 4 hours. Filtration of the resulting crystalline product gave 5.92 g of 3-ethyl-2-methyl-5-methylsulfonamidobenzoxazolium iodide (Intermediate E).

Step 3—Intermediate F).

Intermediate E (1.0 g) and diphenylformamidine (2.2 g) were combined in a flask and heated over a hot air gun with manual stirring until a yellow-orange color formed. The reaction was then heated for 1 minute at full heat until it became totally liquid. On cooling to room temperature, the reaction mixture solidified. This solid was dissolved in 20 ml hot acetone, poured into 100 ml diethyl ether with stirring, and stirred for 1 hour. The solid was then filtered out and washed with diethyl ether to give 1.2 g of 2-(2-anilinovinyl)-3-ethyl-5-methylsulfonamidobenzoxazolium iodide (Intermediate F).

Step 4—Dye 7

Intermediate F (3.8 g) and 20 ml ethanol were combined with stirring, then acetic anhydride (1.08 g) and triethylamine (2.2 g) were added. The mixture was heated with a hot air gun for 30 seconds and then pulverized. 1.5 ml of triethylamine was added and the mixture was heated for 2 minutes, stirred without heating for 5 minutes, cooled to room temperature, diluted with 20 ml isopropyl alcohol, and filtered. The solid was washed with 50 ml isopropyl alcohol, 50 ml diethyl ether, and air dried to yield 3.0 g of orange-brown powder. The solid was recrystallized by dissolving in 75 ml hot chclohexanone, diluting with 200 ml isopropyl alcohol, stored overnight at 2° C., and the solid filtered out, washed with diethyl ether and air dried to yield 2.4 g of Dye 7. The λ-max (methanol) was 446 nm, $\epsilon$-max$=7.84\times10^4$. The pKa's were measured by acid titration in a 50/50 (volume basis) mixture of ethanol and water and determined to be 8.2 for the propylsulfonamido substituent and 9.2 for the lmethjylsulfonamido. The log P was determined to be 3.07.

A—3. Preparation of Dye 16

4.36 g of 1-(4-carboxyphenyl)-3-methyl-2-pyrazolinone was combined with 8.68 g acetanilidovinylbenzoxazolium iodide, 4.0 g triethylamine, and 100 ml ethanol and refluxed. After 45 minutes, an orange solid had formed. The mixture was cooled to room temperature, chilled in ice for 30 minutes, filtered, washed with ethanol and ligroin P950, and air dried to yield 7.4 g of a dull orange powder. This powder was dissolved in 200 ml methanol and 100 ml water with 20 ml triethylamine. The mixture was filtered to remove particulates and the filtrate was acidified to pH 4 with glacial acetic acid while rapidly stirring. The resulting solid was filtered and successively washed with water, ethanol, ligroin P950, and dried to yield 6.75 g of dye 16. The λ-max in methanol and triethylamine was 450 nm, $\epsilon=7.4\times10^4$. NMR analysis indicated the dye had the structure of dye 103.

A-4. Preparation of Dye 17

5.2 g of 1-(3,5-dicarboxyphenyl)-3-methyl-2-pyrazolinone was combined with 9.5 g acetanilidovinyl-benzoxazolium iodide, 6.0 g triethylamine, and 100 ml ethanol and refluxed. After 30 minutes, a dark orange precipitate had formed. The mixture was cooled to room temperature, diluted with 150 ml water, and 5 ml glacial acetic acid was added with rapid stirring. The orange precipitate was filtered, washed with 100 ml water, and dried. This material was slurried in 300 ml refluxing methanol, allowed to cool to room temperature, and stirred for an additional 20 minutes. The solid was filtered, washed with 200 ml methanol, and dried to yield 7.6 g of dye 17. The λ-max in methanol and triethylamine was 452 nm, $\epsilon=7.19=10^4$, melting point=310° C. NMR analysis indicated the dye has the structure of Dye 17.

A-5. Preparation of Dye 18

To a slurry of 3-acetyl-1-(4-carboxyphenyl)-2-pyrazolinone (0.75 g), 3-ethyl-2-(4-methoxy-1,3-butadienylidenyl)benzoxazolium iodide (1.08 g), and 25 ml methanol was added 1.0 ml triethylamine. The mixture was allowed to stand at room temperature for 30 minutes. The deep magenta solid was filtered and washed ethanol and ligroin, and dried to yield 0.85 g of crude dye 4. The dye was recrystallized by slurrying in 30 ml of a 2:1 mixture of ethanol and methanol, heating, chilling with ice, filtering the solid, and washing with ethanol to yield 0.80 g of dye 18. The λ-max in methanol and triethylamine was 562 nm, $\epsilon=11.9\times10^4$. NMR analysis indicated the dye had the structure of Dye 18.

A-6. Preparation of Dye 56

A slurry composed of 1-(4-carboxyphenyl)-3-methyl-2-pyrazolin-5-one (21.8 g, 0.10 mol), 4-dimethylamino-benzaldehyde (14.9 g, 0.10 mol) and EtOH (250 ml) was heated at reflux for two hours. The reaction mixture was cooled to room temperature, resulting in a crude orange product which was isolated by filtration. The product was then washed with ether and dried. The product was purified further by making a slurry of the solid in EtOH (700 ml) at refluxing temperature and filtering the slurry to recover the dye. The treatment was repeated. The mp of the product was above 310° C. The NMR and IR spectra were consistent with the structure assigned. The C, H, and N elemental analyses were in agreement with those calculated for the empirical formula. The pKa of the carboxy substituent was measured by acid titration in a 50/50 volume basis mixture of ethanol and water and determined to be 5.

A-7. Preparation of Dye 61

Step 1

Preparation of
Intermediate—1-(3,5-Dicarboxyphenyl-3-methyl)-2-pyrazolin-5-one

A solution of sodium nitrite (35.8 g, 0.52 mol) in water (75 ml) was added to a slurry of 5-aminoisophthalic acid (90.6 g, 0.50 mol) in 4.8 molar HCl (500 ml) at 0° C. over 15 minutes with stirring. Stirring was continued for one hour at 0–5° C. and the slurry was then added to a solution of sodium sulfite (270 g, 2.2 mol) in water (1.21) all at one time, with stirring, at 2° C. The resulting homogeneous solution was heated at 50°–60° C. for 45 minutes. Concentrated HCl (60 ml) was added and the reaction mixture was heated further at 90° C. for one hour. After cooling to room temperature, another portion of concentrated HCl (500 ml) was added. The solid was isolated by filtration and washed on a funnel with acidified water, EtOH and ligroin in succession. The off-white solid was dissolved in a solution of NaOH (76 g, 1.85 mol in 600 ml water). This solution was subsequently acidified with glacial acetic acid (166 ml, 3.0 mol) to yield a thick slurry. This was isolated by filtration, washed on the funnel with water, EtOH, and ligroin in succession, and thoroughly dried in a vacuum oven at 80° C., and 10 mm Hg. The mp was above 300° C. The NMR and IR spectra were consistent with the structure for 5-hydrazino-1,3-benzenedicarboxylic acid. The product gave a positive test for hydrazine with Tollens' reagent.

A slurry composed of the product 5-hydrazino-1,3-benzenedicarboxylic acid (64.7 g, 0.33 mol), ethylacetoacetate (50.7 g, 0.39 mol) and glacial acetic acid (250 ml) was stirred and refluxed for 22 hours. The mixture was cooled to room temperature and the product that had precipitated was isolated by filtration, washed with water, EtOH, $Et_2O$, and ligroin in succession and thoroughly dried in a vacuum oven at 80° C. and 10 mm Hg. The mp of the solid was above 310° C. The NMR and IR spectra were consistent with the assigned structure. The product gave a negative test with Tollens' reagent. The C,H, and N elemental analyses were in agreement with those calculated for the empirical formula.

Step 2

Preparation of
1-(3,5-Dicarboxyphenyl)-4-(4-dimethylaminobenzylidene)-3-methyl-2-pyrazolin-5-one (Dye 61)

A slurry composed of 1-(3,5-dicarboxphenyl)-3-methyl-2-pyrazoline-5-one (44.6 grams, 0.17 mol), 4-dimethylamino-benzaldehyde (26.9 grams, 0.18 mol) and EtOH (500 mL) was heated at reflux for three hours. The reaction mixture was chilled in ice and the resulting crude orange product was isolated by filtration and washed with EtOH (200 mL). The product was purified by three repetitive slurries of the solid in acetone (1.4 l) at reflux and filtering to recover the dye. The mp of the product was above 310° C. The NMR and IR spectra were consistent with the structure assigned. The C, H, and N elemental analyses were in agreement with those calculated for the empirical formula. The pKa of the carboxy substituent was measured by acid titration in a 50/50 volume basis mixture of ethanol and water and determined to be 5.

A-8. Preparation of Dye 125

1-(p-Carboxyphenyl)-3-methylpyraxolone (21.8 g), trimethoxypropane (8.0 g), ethanol (100 ml), and triethylamine (14.6 g or 20 ml) were combined and boiled under reflux for 30 minutes. The mixture was chilled and then combined with 200 ml methanol, then 40 ml concentrated hydrochloric acid. A red precipitate formed immediately. The mixture was stirred at room temperature for 15 minutes and filtered. The precipitate was washed with 300 ml ethanol, 1000 ml methanol, 1000 ml ether, and then air dried to yield a dry weight of 12.4 g.

The precipitate containing the dye was then purified through a number of washing and dissolution/recrystallization steps. The precipitate was first slurried in 500 ml refluxing glacial acetic acid, cooled to room temperature, filtered, washed with 250 ml acetic acid, 250 ml $H_2O$, 250 ml methanol, and then dried. It was then dissolved in 100 ml hot dimethylsulfoxide and cooled to 40° C. 300 ml methanol was added, upon which a red precipitate formed, which was filtered, washed with methanol, acetone, and ligroin, and dried. This precipitate was dissolved in 200 ml methanol and 6 ml (4.38 g) triethylamine and heated to reflux. 4.8 ml of concentrated hydrochloric acid was added and a fine red precipitate was formed. The solution was filtered while hot and the precipitate was washed with methanol and acetone and dried. The precipitate was then dissolved in a refluxing mixture of 200 ml ethanol and 6.0 ml (4.38 g) triethylamine. 9.0 g of sodium iodide dissolved in 50 ml methanol was added. Upon cooling to room temperature, a red precipitate formed. The mixture was chilled in ice for one hour, then filtered. The precipitate was washed with ethanol, ligroin and dried to yield the sodium salt of the dye.

The sodium salt of the dye was dissolved in 200 ml water with rapid stirring. 6.0 ml concentrated hydrochloric acid was added and a fluffy red precipitate formed. The mixture was filtered and the precipitate was washed with water, methanol, acetone, and ligroin, and dried to yield Dye 125.

The invention has been described in detail with particular reference to preferred embodiments thereof, but it will be understood that variations and modifications can be effected within the spirit and scope of the invention.

What is claimed is:

1. A radiographic element comprised of a film support capable of transmitting radiation to which said radiographic element is responsive having opposed major surfaces, and, coated on said opposed major surfaces, processing solution permeable hardenable hydrophilic colloid layers including at least one silver halide emulsion layer comprised of silver bromide or bromoiodide grains including tabular grains having a thickness of less than 0.3 μm which have an average aspect ratio of greater than 5:1 and account for greater than 50 percent of the total grain projected area and spectral sensitizing dye adsorbed to the surface of said grains in an amount sufficient to substantiality optimally spectrally sensitize said emulsion layer and a layer interposed between said silver halide emulsion layer and said support containing a dye capable of absorbing radiation to which said emulsion layer coated on the opposite of said major surfaces is responsive to reduce crossover, characterized in that said dye in said interposed layer is, prior to processing, in the form of particles and present in an amount sufficient to reduce crossover to less than 10 percent and is capable of being substantially decolorized during processing, said interposed layer contains at least 10 mg/dm$^2$ of hardenable hydrophilic colloid, said emulsion layers contain a combined silver coating coverage sufficient to produce a maximum density on processing in the range of from 3 to 4, a total of from 35 to 65 mg/dm$^2$ of processing solution permeable hardenable hydrophilic colloid is coated on each of said opposed major surfaces of said support, and said processing solution permeable hydrophilic colloid layers are forehardened in an amount sufficient to reduce swelling of said layers to less than 300 percent, percent swelling being determined by (a) incubating said radiographic element at 38° C. for 3 days at 50 percent relative humidity, (b) measuring layer thickness, (c) immersing said radiographic element in distilled water at 21° C. for 3 minutes, and (d) determining the percent change in layer thickness as compared to the layer thickness measured in step (b), whereby said radiographic element exhibits high covering power, reduced crossover without emulsion desensitization, reduced wet pressure sensitivity, and can be developed, fixed, washed, and emerge dry to the touch in a 90 second 35° C. process cycle consisting of

| | |
|---|---|
| development | 24 seconds at 40° C., |
| fixing | 20 seconds at 40° C., |
| washing | 10 seconds at 40° C., and |
| drying | 20 seconds at 65° C., |

where the remaining time is transport between processing steps, the development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |
| Water to 1 liter at pH 10.0, and | |

the fixing step employs the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to | 4.5. |

2. A radiographic element according to claim 1 further characterized in that said emulsion is comprised of tabular grain having a thickness of less than 0.2 μm and an average aspect ratio of greater than 8:1 accounting for greater than 70 percent of the total grain projected area.

3. A radiographic element according to claim 2 further characterized in that said emulsion is spectrally sensitized to at least 60 percent of its highest attainable sensitivity.

4. A radiographic element according to claim 1 further characterized in that said spectral sensitizing dye is present in said emulsion layer in a concentration of corresponding to a 25 to 100 percent monolayer coverage of the grain surface area.

5. A radiographic element according to claim 1 further characterized in that said dye particles are present in an amount sufficient to reduce crossover to less than 5 percent.

6. A radiographic element according to claim 1 further characterized in that said dye particles are present in said under layer units in an amount sufficient to impart a total under layer unit density of at least 2.00.

7. A radiographic element according to claim 6 further characterized in that said dye particles are present in each under layer unit in an amount sufficient to impart an optical density to that layer unit of at least 1.00.

8. A radiographic element according to claim 1 further characterized in that said dye particles have an average diameter of less than 1 μm.

9. A radiographic element according to claim 1 further characterized in that said dye particles are capable of be decolorized to leave a residual density of less than 0.1 after processing of said radiographic element.

10. A radiographic element according to claim 1 further characterized in that said dye forming said particles is an oxonol or merocyanine dye.

11. A radiographic element according to claim 1 further characterized in that said emulsion layers each contain from 18 to 30 mg/dm$^2$ of silver in the form of said grains.

12. A radiographic element according to claim 1 further characterized in that said processing solution permeable hydrophilic colloid layers are forehardened in an amount sufficient to reduce swelling of said layers to less than 200 percent.

13. A radiographic element comprised of a blue tinted film support capable of transmitting radiation to which said radiographic element is responsive having opposed major surfaces, and, coated on said opposed major surfaces, processing solution permeable hardenable hydrophilic colloid layers including at least one silver halide emulsion layer comprised of silver bromide or bromoiodide grains including tabular grains having a thickness of less than 0.2 μm which have an average aspect ratio of at least 12:1 and account for greater than 70 percent of the total grain projected area and blue spectral sensitizing dye adsorbed to the surface of said grains in an amount sufficient to provide a monolayer coverage of from 25 to 100 percent of the surface area of said grains and capable of sensitizing said emulsion layer to at least 60 percent of its maximum attainable sensitivity and a layer interposed between said silver halide emulsion layer and said support containing a yellow dye capable of absorbing radiation to which said emulsion layer coated on the opposite of said major surfaces is responsive to reduce crossover, characterized in that said yellow dye in said interposed layer is, prior to processing, in the form of particles of less than 1 μm in mean diameter present in an amount sufficient to provide an optical density of at least 1.00 in the spectral region of from 400 to 500 nm, thereby reducing crossover to less than 10 percent, said dye being capable of being substantially decolorized during processing, said interposed layer contains at least 10 mg/dm$^2$ of hardenable hydrophilic colloid, said emulsion layers contain a combined silver coating coverage sufficient to produce a maximum density on processing in the range of from 3 to 4, a total of from 35 to 65 mg/dm$^2$ of processing solution permeable hardenable hydrophilic colloid is coated on each of said opposed major surfaces of said support, and said processing solution permeable hydrophilic colloid layers are forehardened in an amount sufficient to reduce swelling of said layers to less than 200 percent, percent swelling being determined by (a) incubating said radiographic element at 38° C. for 3 days at 50 percent relative humidity, (b) measuring layer thickness, (c) immersing said radiographic element in distilled water at 21° C. for 3 minutes, and (d) determining the percent change in layer thickness as compared to the layer thickness measured in step (b), whereby said radiographic element exhibits high covering power, reduced crossover without emulsion desensitization, reduced wet pressure sensitivity, and can be developed, fixed, washed, and emerge dry to the touch in a 90 second 35° C. process cycle consisting of

| | |
|---|---|
| development | 24 seconds at 40° C., |
| fixing | 20 seconds at 40° C., |
| washing | 10 seconds at 40° C., and |
| drying | 20 seconds at 6° C., |

where the remaining time is transport between processing steps, the development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g |
| Glutaraldehyde | 4.9 g |
| Water to 1 liter at pH 10.0, and | |

the fixing step employs the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to | 4.5. |

14. A radiographic element comprised of a blue tinted film support capable of transmitting radiation to which said radiographic element is responsive having opposed major surfaces, and, coated on said opposed major surfaces, processing solution permeable hardenable hydrophilic colloid layers including at least one silver halide emulsion layer comprised of silver bromide or bromoiodide grains including tabular grains having a thickness of less than 0.2 μm which have an average aspect ratio of at least 12:1 and account for greater than 70 percent of the total grain projected area and green spectral sensitizing dye adsorbed to the surface of said grains in an amount sufficient to provide a monolayer coverage of from 25 to 100 percent of the surface area of said grains and capable of sensitizing said emulsion layer to at least 60 percent of its maximum attainable sensitivity and a layer interposed between said silver halide emulsion layer and said support containing a magenta dye capable of absorbing radiation to which said emulsion layer coated on the opposite of said major surfaces is responsive to reduce crossover, characterized in that said magenta dye in said interposed layer is, prior to processing, in the form of particles of less than 1 μm in mean diameter present in an amount sufficient to provide an optical density of at least 1.00 in the spectral region of from 450 to 550 nm, thereby reducing crossover to less than 10 percent, said dye being capable of being substantially decolorized during processing, said interposed layer contains at least 10 mg/dm$^2$ of hardenable hydrophilic colloid, said emulsion layers contain a combined silver coating coverage sufficient to produce a maximum density on processing in the range of from 3 to 4, a total of from 35 to 65 mg/dm$^2$ of processing solution permeable hardenable hydrophilic colloid is coated on each of said opposed major surfaces of said support, and said processing solution permeable hydrophilic colloid layers are forehardened in an amount sufficient to reduce swelling of said layers to less than 200 percent, percent swelling being determined by (a) incubating said radiographic element at 38° C. for 3 days at 50 percent relative humidity, (b) measuring layer thickness, (c) immersing said radiographic element in distilled water at 21° C. for 3 minutes, and (d) determining the percent change in layer thickness as compared to the layer thickness measured in step (b), whereby said radiographic element exhibits high covering power, reduced crossover without emulsion desensitization, reduced wet pressure sensitivity, and can be developed, fixed, washed, and emerge dry to the touch in a 90 second 35° C. process cycle consisting of

| | |
|---|---|
| development | 24 seconds at 40° C., |
| fixing | 20 seconds at 40° C., |
| washing | 10 seconds at 40° C., and |
| drying | 20 seconds at 65° C., |

where the remaining time is transport between processing steps, the development step employs the following developer:

| | |
|---|---|
| Hydroquinone | 30 g |
| 1-Phenyl-3-pyrazolidone | 1.5 g |
| KOH | 21 g |
| $NaHCO_3$ | 7.5 g |
| $K_2SO_3$ | 44.2 g |
| $Na_2S_2O_5$ | 12.6 g |
| NaBr | 35 g |
| 5-Methylbenzotriazole | 0.06 g. |
| Glutaraldehyde | 4.9 g |
| Water to 1 liter at pH 10.0, and | |

the fixing step employs the following fixing composition:

| | |
|---|---|
| Ammonium thiosulfate, 60% | 260.0 g |
| Sodium bisulfite | 180.0 g |
| Boric acid | 25.0 g |
| Acetic acid | 10.0 g |
| Aluminum sulfate | 8.0 g |
| Water to 1 liter at pH 3.9 to | 4.5. |

* * * * *